US006874475B2

(12) United States Patent
Katsura et al.

(10) Patent No.: US 6,874,475 B2
(45) Date of Patent: Apr. 5, 2005

(54) STRUCTURE OF FUEL INJECTOR USING PIEZOELECTRIC ACTUATOR

(75) Inventors: Ryo Katsura, Kariya (JP); Kenji Funai, Kariya (JP); Yutaka Yamada, Suzuka (JP); Ken Mizutani, Yokkaichi (JP)

(73) Assignee: Denso Corporation, Aichi-Pref. (JP)

( * ) Notice: Subject to any disclaimer, the term of this patent is extended or adjusted under 35 U.S.C. 154(b) by 249 days.

(21) Appl. No.: 09/887,562

(22) Filed: Jun. 25, 2001

(65) Prior Publication Data

US 2002/0008159 A1 Jan. 24, 2002

(30) Foreign Application Priority Data

Jun. 26, 2000 (JP) ..... 2000-190488
Dec. 28, 2000 (JP) ..... 2000-400206
May 28, 2001 (JP) ..... 2001-158316

(51) Int. Cl.[7] ..... F02M 37/04
(52) U.S. Cl. ..... 123/467; 123/458; 239/584
(58) Field of Search ..... 123/467, 458, 123/498; 239/102.2, 583, 584, 102.1, 445

(56) References Cited

U.S. PATENT DOCUMENTS 3,418,980 A * 12/1968 Benson ..... 123/498
4,803,393 A 2/1989 Takahashi
5,053,668 A * 10/1991 Mitsuyasu ..... 310/317
5,156,132 A * 10/1992 Iwanaga ..... 123/496
5,438,232 A * 8/1995 Inoue et al. ..... 310/328
5,779,149 A 7/1998 Hayes, Jr.
5,819,710 A * 10/1998 Huber ..... 123/498
5,875,764 A 3/1999 Kappel et al.
6,062,533 A 5/2000 Kappel et al.
6,172,445 B1 1/2001 Heinz et al.
6,291,929 B1 * 9/2001 Heinz et al. ..... 310/328
6,298,829 B1 * 10/2001 Welch et al. ..... 123/467
6,371,084 B1 * 4/2002 Betz ..... 123/467
6,422,210 B1 * 7/2002 Lambert et al. ..... 123/496
6,499,471 B2 * 12/2002 Shen et al. ..... 123/498

FOREIGN PATENT DOCUMENTS

| | | |
|---|---|---|
| DE | 196 50 900 A2 | 6/1998 |
| DE | 19724637 | 12/1998 |
| DE | 198 56 202 A1 | 6/2000 |
| EP | 0790402 | 8/1997 |
| EP | 0816670 A1 | 1/1998 |
| EP | 0 179 098 A2 | 8/2000 |
| JP | 59222977 | 12/1984 |
| JP | 05110154 | 4/1993 |
| JP | 2508321 | 4/1996 |
| JP | 9-184463 | 7/1997 |
| JP | 2893739 | 3/1999 |
| WO | WO 99/58840 | 11/1999 |
| WO | WO 00/57049 | 9/2000 |

OTHER PUBLICATIONS

Patent Abstracts of Japan, vol. 009, No. 095 (E–310), Apr. 24, 1985 & JP 59 222977 A (Nippon Jidosha Buhin Sogo Kenkyusho KK), Dec. 14, 1984.
Patent Abstracts of Japan, vol. 1999, No. 04, Apr. 30, 1999 & JP 11 022586 A (Nissan Motor Co Ltd), Jan. 26, 1999.
Patent Abstracts of Japan, vol. 1999, No. 01, Jan. 29, 1999 & JP 10 288121 A (Nissan Motor Co Ltd), Oct. 27, 1998.

* cited by examiner

*Primary Examiner*—Carl S. Miller
(74) *Attorney, Agent, or Firm*—Nixon & Vanderhye PC

(57) ABSTRACT

A fuel injector for an internal combustion engine is provided. The fuel injector has a simple structure so that it is easy to install and remove a piezoelectric valve actuator in and from the fuel injector, and to adjust fuel injection characteristics finely which allows the overall size of the fuel injector to be decreased. The fuel injector includes a housing to be installed in the engine and a structural element serving to install the piezoelectric valve actuator in the housing to be detachable easily. The piezoelectric valve actuator is retained in an actuator casing fitted in the housing so that it can expand or contract to move a needle valve. The actuator casing has an extensible portion in itself or is coupled to a bellows in alignment for enabling the piezoelectric valve actuator to expand, thereby allowing the size of the actuator casing to be minimized.

23 Claims, 22 Drawing Sheets

STRUCTURE OF FUEL INJECTOR USING PIEZOELECTRIC ACTUATOR

BACKGROUND OF THE INVENTION

1. Technical Field of the Invention

The present invention relates generally to a fuel injector for internal combustion engines, and more particularly to an improved structure of a fuel injector for installation of a piezoelectric device used as a valve actuator of the fuel injector.

2. Background Art

Typical fuel injectors used in, for example, internal combustion diesel engines of automotive vehicles are designed to drive a three-way valve or a two-way valve connected to a common rail in which a high pressure fuel is stored for opening and closing a fuel supply passage selectively. When it is required to inject the fuel into the engine, the fuel injector changes the fuel pressure acting on a needle to lift up the needle for opening a spray hole to initiate the fuel injection.

As a valve actuator to open and close the three-way valve or the two-way valve, a solenoid valve has been usually used. In recent years, however, an attempt is made to utilize an piezoelectric device which expands or contracts in response to input of an electric signal to actuate a valve for controlling the fuel injection precisely. For example, a valve actuator is proposed which consists of a piezoelectric device made up of a stack of piezoelectric layers and a piston. In operation, the voltage is applied to the piezoelectric device. The piezoelectric device then contracts or expands to move the piston to open or close, for example, a three-way valve to control the back pressure of a nozzle needle of a fuel injector. The three-way valve works to switch communications between a back pressure chamber formed adjacent the nozzle needle and a high-pressure fuel path and between the back pressure chamber and a drain passage. When the back pressure chamber communicates with the fuel passage so that the pressure in the back pressure chamber drops, it will cause the nozzle needle to be lifted up to initiate a jet of fuel from a spray hole. Alternatively, when the back pressure chamber communicates with the high-pressure fuel passage, the fuel flows from the high-pressure fuel passage to the back pressure chamber, thereby moving the nozzle needle downward to close the spray hole.

The piezoelectric device is made by laminating the piezoelectric layers each having upper and lower surfaces on which electrodes are formed and applying a conductive paste to a side surface of the lamination to form side terminals which connect negative and positive sides of the electrodes, respectively. Installation of the piezoelectric device in a housing is accomplished by coupling the side terminals to a connector through leads, fitting an insulator tube on the periphery of the piezoelectric device, and inserting it into a vertical chamber of the housing. After the installation of the piezoelectric device, a hermetic seal is formed by placing the whole of the housing in a mold and forcing resin into the mold to seal an upper end of the housing.

The piezoelectric device is usually made from PZT (lead zirconate titanate). The PZT contains the lead that is a harmful substance and thus needs to be withdrawn after the piezoelectric device is used up. The withdrawal of the lead requires cutting the housing because the upper end of the housing is, as described above, sealed by resin. It is, thus, quite inconvenient. Further, there is a problem that parts cannot be removed from the housing after assembly thereof, therefore, it is impossible to replace the parts and adjust characteristics of the fuel injection finely.

The piezoelectric device, the insulator tube, and the connector are not secured completely during assembly thereof and thus are not easy to handle, which may lead to the breakage of the insulator tube. The connector is covered with a resin material using a mold after the fu(:l injector is assembled to insulate the connector from the injector body and thus is fixed in orientation thereof in a circumferential direction of the injector. Accordingly, it is necessary to prepare a connector mold for every type of engine, resulting in an increase in manufacturing cost of the injector.

Japanese Patent No. 3010835 discloses a piezoelectric device which is disposed hermetically within a casing which has a bellows for avoiding the ingress of moisture or foreign objects into the piezoelectric device. This structure, however, has the drawbacks in that the bellows has a larger diameter and is difficult to install in small-sized fuel injectors. If the size of the piezoelectric device is decreased to match with that of the fuel injectors, it may cause the performance thereof to be reduced. For theses reasons, fuel injectors equipped with the piezoelectric device as an actuator are not yet put into practical use.

SUMMARY OF THE INVENTION

It is therefore a principal object of the invention to avoid the disadvantages of the prior art.

Other objects of the invention are to provide an improved structure of a fuel injector which is easy to install, to remove a piezoelectric actuator in and from the fuel injectors and to adjust fuel injection characteristics finely which allows an overall size of the fuel injector to be decreased.

According to one aspect of the invention, there is provided an improved structure of a fuel injector for an internal combustion engine. The fuel injector comprises: (a) a housing to be installed in the engine with a portion of the housing exposed outside the engine; (b) an actuator including an electrically deformable element which works to be deformed in response to input of an electric signal for opening and closing a spray hole selectively; and (c) a structural element installing the actuator in the housing detachably.

In the preferred mode of the invention, the housing has a length and an end portion thereof exposed outside the engine. A nozzle needle is disposed within the housing in alignment with the actuator so as to be moved in a lengthwise direction of the housing by the deformation of the actuator to open and close the spray hole selectively. The structural element secures the actuator so that the actuator is detachable from the end portion of the housing opposite the nozzle needle across the actuator.

The actuator has a length with a first end oriented toward the portion of the housing exposed outside the engine. A connector is coupled integrally with the first end of the actuator for establishing an electric connection between the actuator and a power source.

The housing has firmed therein a vertical chamber which has an opening oriented to a first end of the housing exposed outside the engine. The structural element includes a fastening member which retains the actuator detachably within the vertical chamber. The nozzle needle is disposed in alignment with the actuator within a chamber formed in the housing opposite the first end across the vertical chamber so as to be moved in a lengthwise direction of the housing by the deformation of the actuator to open and close the spray hole selectively.

The connector may alternatively be installed detachably in the opening of the vertical chamber.

The connector may include a connector body which is coupled integrally with the actuator and retains therein leads connecting with the actuator in an electrically insulating fashion.

A spacer may be disposed between a flange coupled with the first end of the actuator and a shoulder formed in the housing for adjusting a lengthwise location of the actuator within the vertical chamber.

The fastening member is fastened to the opening of the vertical chamber in the housing to hold the actuator detachably within the vertical chamber. A positioning means is provided for positioning the actuator within the vertical chamber without being subjected to torque or unbalanced load arising from fastening of the fastening member.

The connector includes an electric terminal portion and a connector body extending from a surface of the electric terminal portion. The fastening member may be implemented by a retaining nut through which the connector body extends. The retaining nut is installed in the opening of the vertical chamber with an outer end facing the surface of the electric terminal portion of the connector through a gap of 5 to 10 mm so that a portion of the connector body is exposed outside the retaining nut.

The structural element may alternatively be implemented by one of a screw and a structural member joined to the housing by one of staking, welding, and bonding.

A joint of the structural member and the housing may be set more fragile than any other portions.

At least one fragile portion may be formed on the housing for facilitating ease of cutting or breaking up the housing for withdrawing the actuator.

The electrically deformable element may be implemented by a piezoelectric device designed to expand and contract in response to the input of the electric signal. The piezoelectric device is made up of a stack of piezoelectric layers and electrode layers each interposed between an adjacent two of the piezoelectric layers.

According to the second aspect of the invention, there is provided a fuel injector for an internal combustion engine which comprises: (a) a hollow cylindrical housing having a first and a second opening formed in opposed ends thereof, respectively; (b) an actuator disposed within the housing, the actuator including an electrically deformable element which works to be deformed in response to input of an electric signal; (c) a first plate installed on one of the ends of the housing to seal the first opening hermetically; and (d) a second plate installed on the other end of the housing to seal the second opening hermetically, the second plate being so coupled to the housing as to transform the deformation of the electrically deformable element of the actuator into a stroke of a needle for opening and closing a spray hole selectively.

In the preferred mode of the invention, the second plate is coupled to the housing so as to be displaced in response to the deformation of the electrically deformable element to produce the stroke of the needle.

The second plate may alternatively be coupled to the housing so as to be deformed elastically in response to the deformation of the electrically deformable element to produce the stroke of the needle.

The housing includes a bellows which expands and contracts following the deformation of the electrically deformable element.

A piston is coupled at an end thereof to the electrically deformable element so as to move following deformation of the electrically deformable element within the cylindrical housing. The second plate may be a diaphragm coupled to the housing in contact with the other end of the piston.

The diaphragm may be coupled to the housing in contact with an end of the rod of the piston. An annular seat member is installed within the second opening of the cylindrical housing through which the rod of the piston extends. A spring member is disposed on the seat member to exert a given pressure on the electrically deformation member in a lengthwise direction thereof.

The cylindrical housing may have a bellows formed on the end in which the second opening is defined. In this case, the second plate made of a diaphragm is coupled to an end of the bellows to close the second opening.

The cylindrical housing may be so designed as to extend following the deformation of the electrically deformable element. At least two of the cylindrical housing, the first plate, and the second plate may be formed integrally with each other. The electrically deformable element may be isolated from fluid within the fuel injector.

The electrically deformable element may be implemented by a piezoelectric device designed to expand and contract in response to the input of the electric signal. The piezoelectric device is made up of a stack of piezoelectric layers and electrode layers each interposed between an adjacent two of the piezoelectric layers.

According to the third aspect of the invention, there is provided a fuel injector for an internal combustion engine which comprises: (a) a hollow cylindrical housing; (b) an actuator disposed within the housing, the actuator including an electrically deformable element which works to expand and contract selectively in a lengthwise direction thereof in response to input of an electric signal; (c) a piston coupled at an end thereof to the electrically deformable element in alignment therewith so as to move following the expansion and contraction of the electrically deformable element; and (d) an extensible member in which the piston is disposed, the extensible member extending in a lengthwise direction thereof so as to allow the piston to move to displace a needle for opening and closing a spray hole selectively, the extensible member being coupled to the housing in alignment therewith in a direction of expansion and contraction of the electrically deformable element.

In the preferred .mode of the invention, the extensible member is implemented by a bellows.

A plate is joined to the other end of the piston. If a minimum diameter of the cylindrical housing is defined as A, a minimum diameter of the plate is defined as B, and a maximum diameter of the extensible member is defined as C, at least one of relations of $A>C$ and $B>C$ is satisfied.

The end of the piston coupled to the electrically deformable element is disposed within the cylindrical housing. If a maximum clearance between the end of the piston and an inner wall of the cylindrical housing is defined as d, and a minimum clearance between the piston and an inner wall of the extensible member is defined as e, a relation of $d<e$ is satisfied.

A first plate is joined to a first end of the cylindrical housing. A second plate is Jointed to a second end of the cylindrical housing opposite the first end. At least two of the cylindrical housing, the extensible member, the first plate, and the second plate are formed integrally with each other. The electrically deformable element is isolated from fluid within the fuel injector.

The electrically deformable element may be implemented by a piezoelectric device designed to expand and contract in response to the input of the electric signal. The piezoelectric device is made up of a stack of piezoelectric layers and electrode layers each interposed between an adjacent two of the piezoelectric layers.

BRIEF DESCRIPTION OF THE DRAWINGS

The present invention will be understood more fully from the detailed description giver, hereinbelow and from the accompanying drawings of the preferred embodiments of the invention, which, however, should not be taken to limit the invention to the specific embodiments but are for the purpose of explanation and understanding only.

In the drawings:

FIG. 7(*b*) is a bottom view of the connector of FIG. 7(*a*);

FIG. 12(*c*) is an exploded view which shows a stack of piezoelectric layers making up a drive portion of the piezoelectric device of FIG. 11;

DESCRIPTION OF THE PREFERRED EMBODIMENTS

Figure 1:
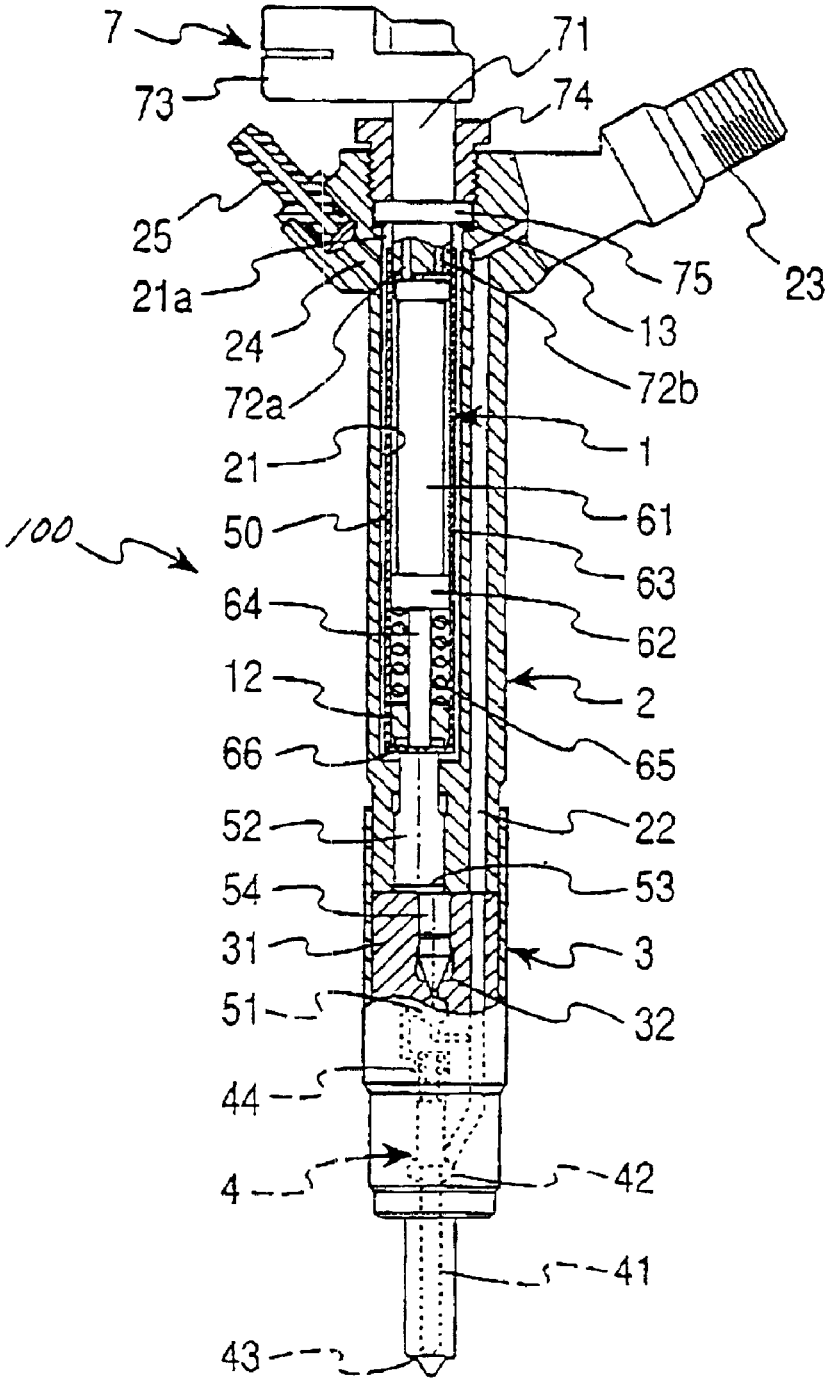
FIG. 1 is a vertical sectional view which shows a fuel injector according to the first embodiment of the invention.
Figure 2:
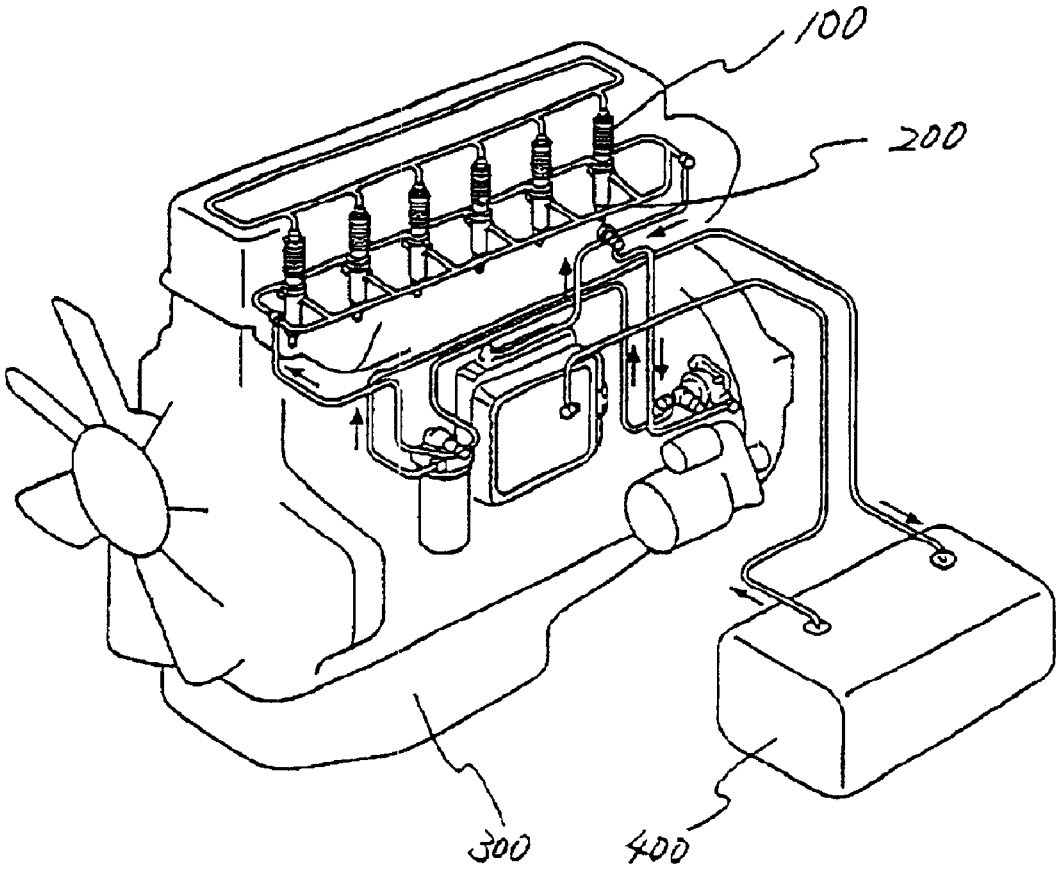
FIG. 2 is a perspective view which shows a common rail system for a diesel engine using fuel injectors of the types shown in FIG. 1.

Referring to the drawings, wherein like reference numbers refer to like parts in several views, particularly to FIG. 1, there is shown a fuel injector 100 according to the invention. The following discussion will refer to, as an example, a common rail fuel injection system, as shown in FIG. 2, in which the fuel injector 100 is provided for each cylinder of a diesel engine 300.

The common rail fuel injection system includes a common rail 200 which accumulates therein fuel supplied from a fuel tank 400 elevated in pressure by a fuel pump installed in the engine 300. When it is required to inject the fuel into the engine 300, the fuel stored under high pressure in the common rail 200 is supplied to the fuel injectors 100.

The fuel injector 100 includes, as shown in FIG. 1, an upper housing 2, in which an actuator 1 is disposed, and a lower housing 3, which is jointed to the upper housing 2 in alignment therewith, and an injection nozzle 4.

The upper housing 2 is made of a hollow cylindrical member and has a vertical chamber 21 formed eccentrically with a longitudinal center line thereof. In the vertical chamber 21, the actuator 1 is disposed. The upper housing 2 has formed therein a high-pressure fuel passage 22 which extends in parallel to the vertical chamber 21 and connects at an upper end thereof to a fuel inlet connector 23. The fuel inlet connector 23 projects outside the upper housing 2 (i.e., the cylinder of the engine 300) and communicates with the common rail 200, as shown in FIG. 2. An fuel outlet connector 25 is installed in an upper portion of the upper housing 2 opposite the fuel inlet connector 23. The fuel flowing into a drain passage 24 is discharged from the fuel outlet connector 25 to the fuel tank 400. The drain passage 24 leads to a gap 50 between an inner wall of the vertical chamber 21 and the actuator 1 and to a three-way valve 51 through a passage (not shown) extending vertically through the upper and lower housings 2 and 3.

The injection nozzle 4 has a needle 41 and a spray hole 43. The needle 41 is slidable vertically within a nozzle block 31 to spray fuel in a fuel sump 42 from the spray hole 43. The fuel sump 42 is defined around a middle portion of the needle 41 and leads to a lower end of the high-pressure fuel passage 22. The needle 41 is applied with the pressure of the fuel in the fuel sump 42 which works to move the needle 41 in an upward direction (also referred to as a valve-opening direction below) and the pressure of the fuel in a back pressure chamber 44 which works to move the needle 41 in a downward direction (also referred to as a valve-closing direction below). When the pressure in the back pressure chamber 44 drops, it will cause the needle 41 to be lifted upward to open the spray hole 43, initiating a fuel jet.

The pressure in the back pressure chamber 44 is controlled by the three-way valve 51. This pressure control is achieved by selectively establishing communications between the back pressure chamber 44 and the high-pressure fuel passage 22 and between the back pressure chamber 44 and the drain passage 24. The switching of these communications is achieved by moving a ball of the three-way valve 51, as indicated by a broken line in FIG. 1. The movement of the ball is accomplished by displacing a large-diameter piston 52 and a small-diameter piston 54 through the actuator 1. The small-diameter piston 54 is hydraulically coupled with the large-diameter piston 52 through a pressure chamber 53. Three-way valves are known per se, and explanation thereof in detail will be omitted here.

Figure 3:
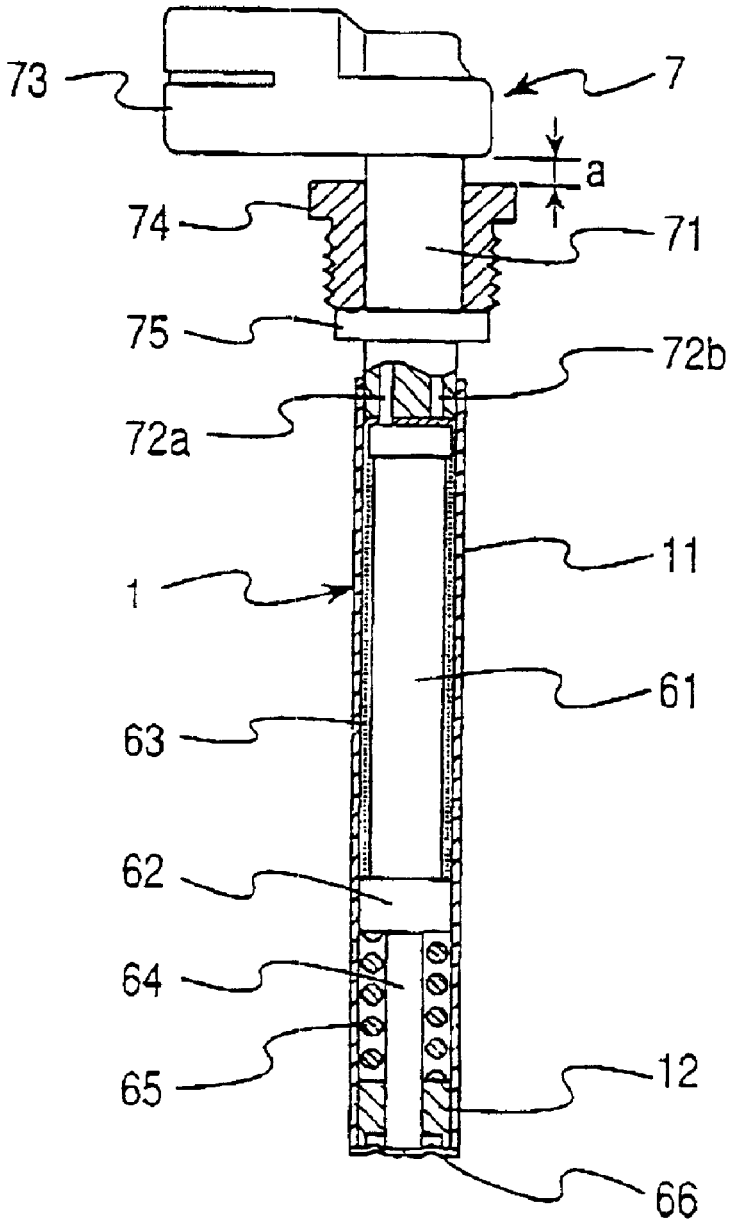
FIG. 3 is a vertical sectional view which shows an actuator installed in the fuel injector of FIG. 1.

The actuator 1, as clearly shown in FIG. 3, consists essentially of a thin-walled metallic hollow cylindrical housing 11, a laminated piezoelectric device (also called a piezo stack) 61, and a piston 62. The piezoelectric device 61 is disposed within an upper portion of the housing 11. The piston 62 is disposed slidably within the housing 11 in alignment with the piezoelectric device 61.

The piezoelectric device 61 may be of a known type which is, as will be described in detail later, made up of a stack of piezoelectric discs each having electrodes formed on both surfaces thereof. A conductive paste is applied to a side wall of the stack of the piezoelectric discs to form side terminals (not shown) connecting positive and negative sides of the electrodes, respectively. The side terminals are coupled to leads 72*a* and 72*b* of a connector 7. The application of voltage to the piezoelectric device 61 through the connector 7 will cause the piezoelectric device 61 to contract or expand in a longitudinal direction thereof. An insulator 63 is disposed within the housing 11 so as to surround the periphery of the piezoelectric device 61 to isolate the piezoelectric device 61 electrically from the housing 11.

The connector 7 has, as clearly shown in FIG. 3, a cylindrical connector body 71 welded to an upper open end of the housing 11. The leads 72*a* and 72*b* extend through vertical holes (not shown) formed in the connector body 71 and connect with a connector terminal or plug 73 disposed on the connector body 71. The leads 72*a* and 72*b* are hermetically sealed in the connector body 71 for providing for airtightness and electric insulation. The connector body 71 has a flange 75 on which a retaining nut 74 is disposed around the periphery of the connector body 71. The retaining nut 74 is, as shown in FIG. 1, screwed into an upper end of the upper housing 2 to install the connector 7 in the upper housing 2. The plug 73 of the connector 7 is held at an interval a of 5 to 10 mm away from an upper end of the retaining nut 74 so as to expose an upper portion of the connector body 7 outside the retaining nut 74 for facilitating, as will be described later in detail, ease of positioning the actuator 1 within the vertical chamber 21.

The piston 62 has a small-diameter rod 64 extending downward, as viewed in FIG. 3, from a lower surface thereof. An annular seat 12 is welded to an inner wall of the housing 11. A coil spring 65 is disposed between an upper surface of the annular seat 12 and the lower surface of the piston 62 around the rod 64 to urge the piston 62 upward into constant engagement with a lower end of the piezoelectric device 61. The rod 64 extends slidably through a central hole of the annular seat 12 and reaches a diaphragm 66 mounted on a lower end of the housing 11. The diaphragm 66 is made of a thin metallic disc in the form of a conical spring and welded at a peripheral edge thereof to a ring formed on a lower end of the annular seat 12, thereby sealing a lower opening of the housing 11 hermetically.

The diaphragm 66 is elastically deformed by vertical movement of the rod 64. Specifically, when energized, the piezoelectric device 61 expands vertically and pushes the piston 62 downward, as viewed in FIG. 3, to project the diaphragm 66 downward through the rod 64. This causes the large-diameter piston 52 disposed, as shown in FIG. 1, in the upper housing 2 in contact with the diaphragm 66 to move downward. Specifically, a stoke of the piston 62 produced by the expansion of the piezoelectric device 61 is transmitted through the diaphragm 66 to the large-diameter piston 52. The large-diameter piston 52 is installed coaxially with the vertical chamber 21 of the upper housing 2 so as to be slidable within the upper housing 2. The downward movement of the large-diameter piston 52 is transformed into a rise in pressure in the pressure chamber 53. as shown in FIG. 1, defined between the upper and lower housings 2 and 3, which is, in turn, causes the small-diameter piston 54 to be shifted downward. The small-diameter piston 54 is disposed slidably within a cylindrical chamber 32 formed in the lower housing 3 coaxially with the fuel injector 100. The vertical movement of the piezoelectric device 61 (i.e., the stoke of the large-diameter piston 52) is amplified as a function of a difference in diameter between the large-diameter piston 52 and the small-diameter piston 54.

The fabrication of the actuator 1 is accomplished by inserting the annular seat 12 having the diaphragm 66 welded to the bottom thereof into the housing 11 from the lower opening, welding the annular seat 12 to the inner wall of the housing 11, putting the spring 65, the piston 62, and the piezoelectric device 61 covered with the cylindrical insulator 63 into the housing 11 from the upper opening, welding the connector body 71 to the upper end of the housing 11, and placing this assembly in a mold to form a resinous block of the plug 73 of the connector 7.

The installation of the thus fabricated actuator 1 in the upper housing 2 is accomplished by inserting the actuator 1 into the vertical chamber 21 from the upper opening thereof, holding the upper portion of the connector body 71, as indicated at a in FIG. 3, using a given jig or a tool, and fastening the retaining nut 74. A shoulder 21*a* is formed on the inner wall of the vertical chamber 21 to define an upper large bore whose inner wall is threaded. The flange 75 of the connector body 71 is seated on the shoulder 21*a* through a ring shim 13. The shim 13 works to seal a gap between the flange 75 and the shoulder 21*a* and also serves as a spacer for adjusting the vertical position of the actuator 1 within the vertical chamber 21 to regulate :he injection characteristics of the fuel injector 100 (e.g., the amount of fuel to be sprayed) finely.

The use of the retaining nut 74 to secure the actuator 1 in the upper housing 2 facilitates ease of removal of the actuator 1 after used up and allows the plug 73 of the connector 7 to be adjusted in orientation easily. When the retaining nut 74 is fastened, the gap a of 5–10 mm is kept between the bottom of the plug 73 and the upper end of the retaining nut 74. The upper portion of the connector body 71 is held by a tool such as a damper or nipper. This avoids application of undesirable torque or unbalanced load to the actuator 1 during installation in the upper housing 2.

The piezoelectric device 61 is protected by the housing 11. The leads 72*a* and 72*b* connected to the piezoelectric device 61 are held by the connector body 71 welded to the housing 11, thus facilitating ease of handing of the actuator 1 and ensuring high degrees of airtightness and electric insulation of the whole of the actuator 1. This also enables use of the gap 50 between the inner wall of the vertical chamber 21 and the outer wall of the actuator 1 as a drain passage, thus resulting in a decrease in holes to be drilled in the upper housing 2. The small-diameter piston 54 is formed coaxially with the upper housing 2, thus resulting in a decrease in overall length of an eccentric hole (i.e., the vertical chamber 21 and a chamber in which the large-diameter piston 52 is disposed), thereby facilitating ease of machining of the eccentric hole.

In operation of the fuel injector 1, when it is required to inject the fuel into the engine 300, an engine controller (not shown) applies the voltage to the piezoelectric device 61, so that the piezoelectric device 61 extends and pushes the piston 62, the diaphragm 66, and the large-diameter piston 52 downward, as viewed in FIG. 1. The downward movement of the large-diameter piston 52 causes the volume of the pressure chamber 53 to be decreased, thus resulting in a rise in pressure in the pressure chamber. 53 This causes the small-diameter piston 54 to move to push the ball of the three-way valve 51 downward, so that the fuel in the back pressure chamber 44 flows to the drain passage 24, thereby decreasing the fuel pressure in the back pressure chamber 44. This causes the needle 41 to be lifted up to open the spray hole 43, so that the fuel in the fuel sump 42 is sprayed into the engine 300. When it is required to stop the spray of the fuel, the engine controller drops the voltage applied to the piezoelectric device 61 to contract it, thereby causing the piston 62 to be lifted upward by the spring pressure of the coil spring 65. The diaphragm 66 and the large-diameter piston 52 are thus moved upward, so that the pressure in the pressure chamber 53 drops, thus causing the small-diameter piston 54 to be lifted upward. The lifting of the small-diameter piston 54 causes the ball of the three-way valve 51 to be moved upward to establish the communication between the high-pressure fuel passage 22 and the back pressure chamber 44, so that the fuel pressure in the back pressure chamber 44 is elevated to push the needle 41 downward, thereby closing the spray hole 43.

Figure 4:
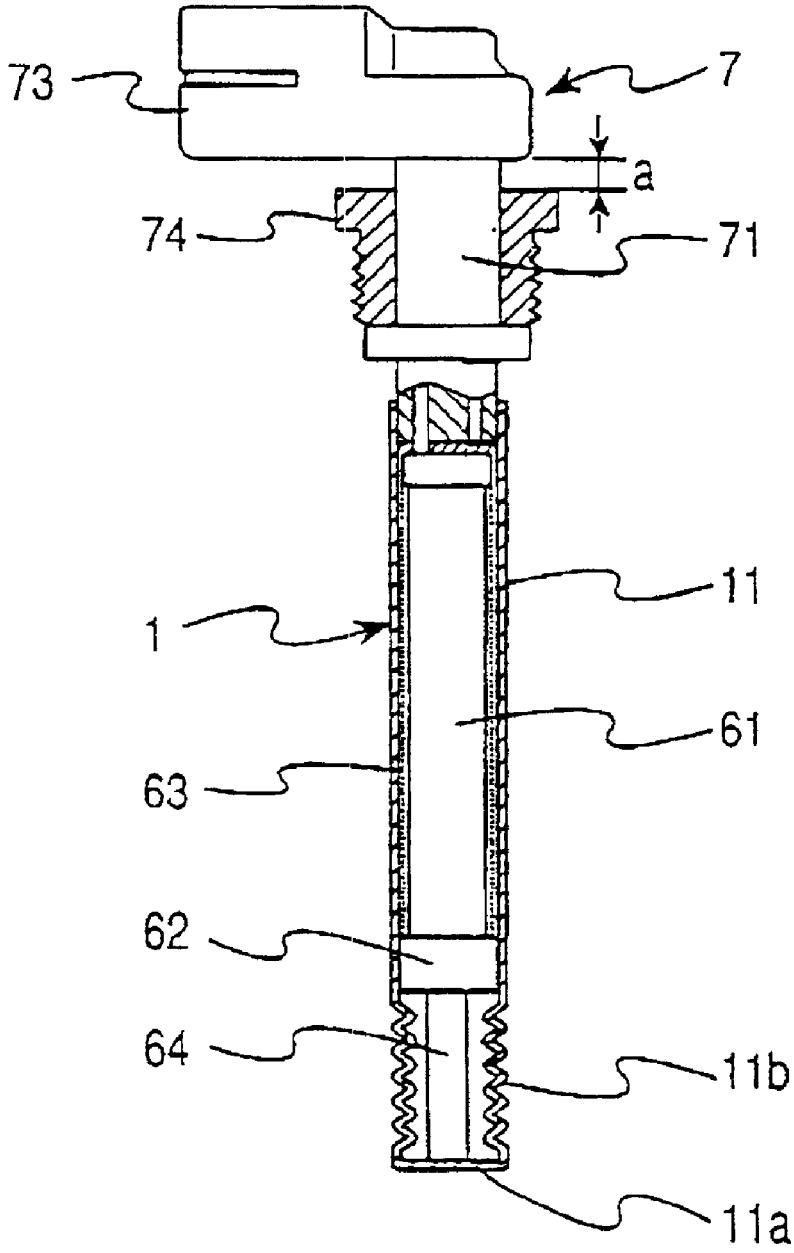
FIG. 4 is a vertical sectional view which shows an actuator according to the second embodiment of the invention.

FIG. 4 shows the actuator 1 according to the second embodiment of the invention.

A bellows 11*b* is coupled with the lower end of the housing 121. The bellows 11*b* is closed at a lower opening thereof by a diaphragm 11*a*. The diaphragm 11*a* is in contact with the bottom of the rod 64 of the piston 62. The bellows 11*b* has substantially the same length as that of the rod 64 and urges the piston 62 into constant engagement with the bottom of the piezoelectric device 61. The downward movement of the rod 64 will cause the bellows 11*b* to expand, so that the diaphragm 11*a* moves downward.

Other arrangements are identical with those in the first embodiment, and explanation thereof in detail will be omitted here.

Figure 5:
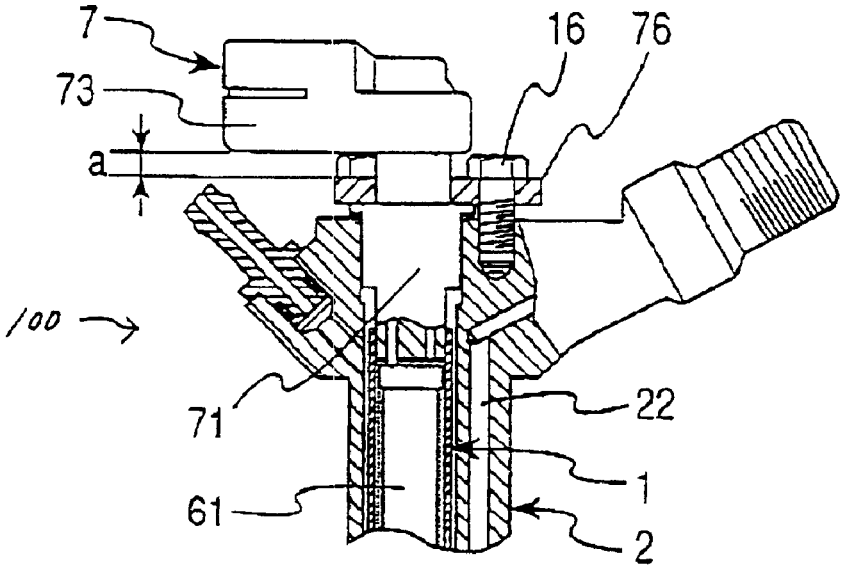
FIG. 5 is a partially sectional view which shows an actuator according to the third embodiment of the invention.

FIG. 5 shows the fuel injector 100 according to the third embodiment of the invention.

The connector body 71 is fitted directly in the upper opening of the upper housing 2 with a flange 78 placed on the upper end of the upper housing 2. A mount plate 76 is secured on the upper end of the upper housing 2 using bolts 16 to nip the flange 78 between itself and the upper end of the upper housing 2 to retain the actuator 1 in the upper housing 2 firmly. The gap a of 5–10 mm is kept, like the first embodiment, between the bottom of the plug 73 and the upper end of the mount plate 76 for avoiding application of undesirable torque or unbalanced load to the actuator 1 during installation in the upper housing 2.

Other arrangements are identical with those in the first embodiment, and explanation thereof in detail will be omitted here.

Figure 6:
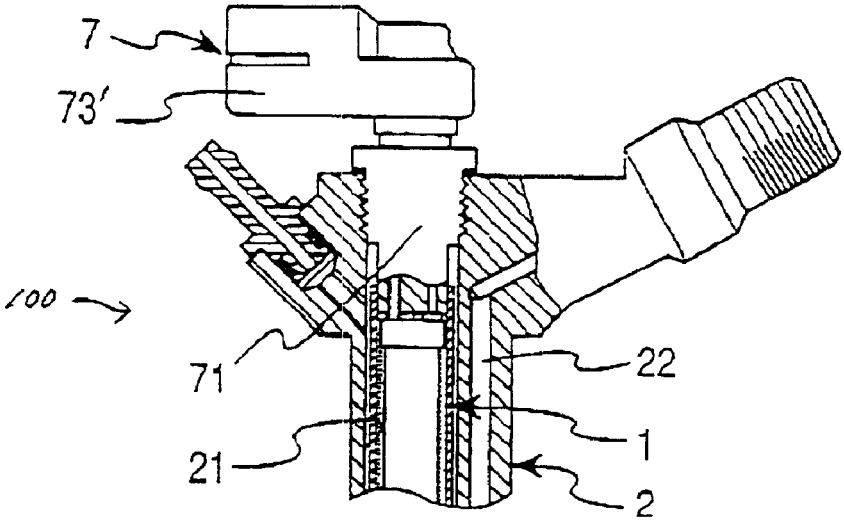
FIG. 6 is a partially sectional view which shows an actuator according to the fourth embodiment of the invention.

FIG. 6 shows the fuel injector 100 according to the fourth embodiment of the invention.

The connector body 71 of the connector 7 is machined to an illustrated shape. Specifically, a threaded portion identical with the retaining nut 74 in the first embodiment is formed on the connector body 71 to screw the connector body 71 directly into the upper opening of the upper housing 2.

Figure 7A:
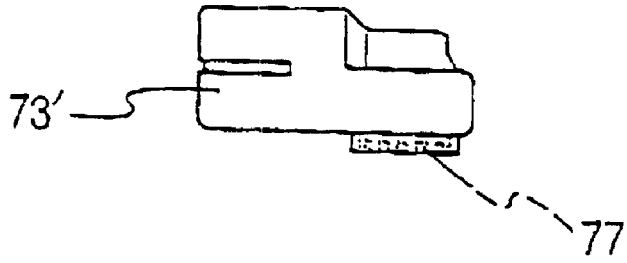
FIG. 7(*a*) is a side view which shows a connector for establishing an electric connection between a power supply and an actuator of FIG. 6.
Figure 7B:
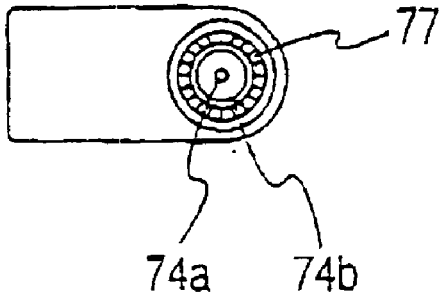

The connector 7 has a plug 73', as shown in FIGS. 7(*a*) and 7(*b*), which is fitted on an upper portion of the connector body 71. The plug 73' has formed on the bottom thereof an annular rail 77. The annular rail 77 has a plurality of protrusions formed around an outer periphery thereof which establish firm engagement with the connector body 71 when the plug 73' is fitted in the connector body 71 for holding the plug 73' from rotating about the connector body 71. A positive terminal 74*a* is, as clearly shown in FIG. 7(*b*), provided in the center of the annular rail 77. A negative annular terminal 74*b* is disposed coaxially with the positive terminal 74*a*. The annular rail 77 is fitted in an annular groove formed in the upper end of the connector body 71 to establish electric connections of the positive and negative terminals 74*a* and 74*b* with the leads 72*a* and 72*b*.

Other arrangements are identical with those in the first embodiment, and explanation thereof in detail will be omitted here.

Figure 8:
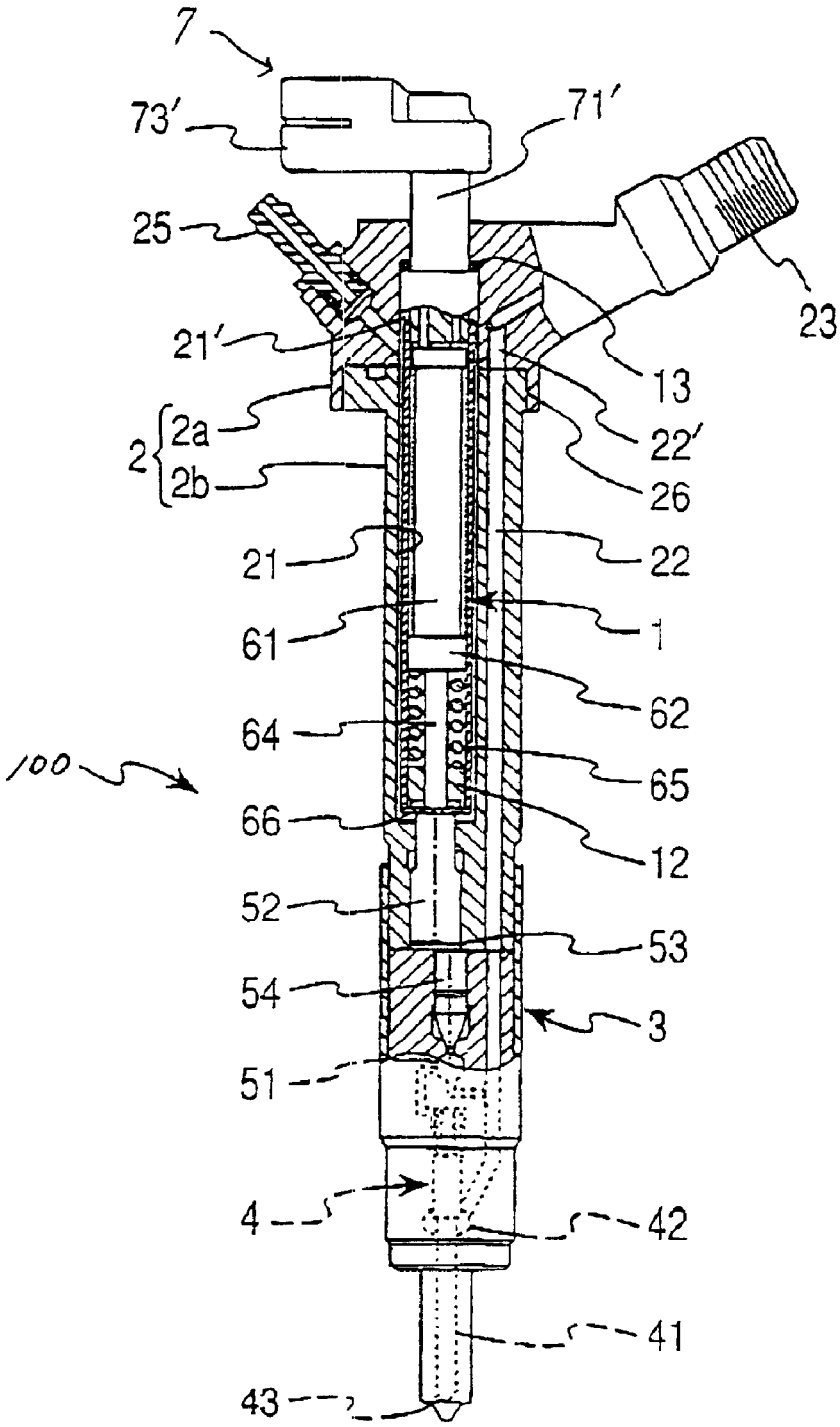
FIG. 8 is a vertical sectional view which shows a fuel injector according to the fifth embodiment of the invention.

FIG. 8 shows the fuel injector 100 according to the fifth embodiment of the invention.

The upper housing 2 consists of two parts: a head 2*a* and a cylinder 2*b*. The head 2*a* has, like the first embodiment, the fuel inlet connector 23 and the fuel outlet connector 25 and also has formed therein a cylindrical chamber 21' and a fuel inlet passage 22'. When the head 2*a* is fitted on the cylinder 2*b*, the cylindrical chamber 21' and the fuel inlet passage 22' communicate with the vertical chamber 21 and the high-pressure fuel passage 22, respectively. The connector 7 has the plug 73' identical in structure with the one in the fourth embodiment of FIG. 6. The connector body 71' consists of an upper small-diameter portion and a lower large-diameter portion. The lower large-diameter portion is fitted in the cylindrical chamber 21' in engagement with an upper inner wall of the cylindrical chamber 21' through the shim 13.

The installation of the actuator 1 in the upper housing 2 is initiated without fitting the plug 73' on the connector body 71'. Specifically, the actuator 1 is first inserted into the cylinder 2*b* of the upper housing 2, after which the head 2*a* is coupled to the connector body 71' in a screw fashion. The head 2*a* has formed in a bottom thereof an annular chamber 26 which has a threaded inner wall. The cylinder 2*b* has an upper flange whose peripheral wall is threaded and engages the inner wall of the annular chamber 26. The connector body 71' is, as described above, retained in the cylindrical chamber 21' through the shim 13. Finally, the plug 73' is fitted on the connector body 71' in a desired orientation.

The cylindrical chamber 21' is formed in the head 2*a* coaxially with a vertical center line of the head 2*a*, thereby resulting in a decreased in length of an eccentric hole (i.e., the vertical chamber 21 and the chamber in which the large-diameter piston 52 is disposed), thereby facilitating ease of machining of the eccentric hole.

Other arrangements are identical with those in the first embodiment, and explanation thereof in detail will be omitted here.

FIGS. 9 to 12(*c*) shows the fuel injector 100 according to the sixth embodiment of the invention which is a modification of the fifth embodiment.

Figure 10:
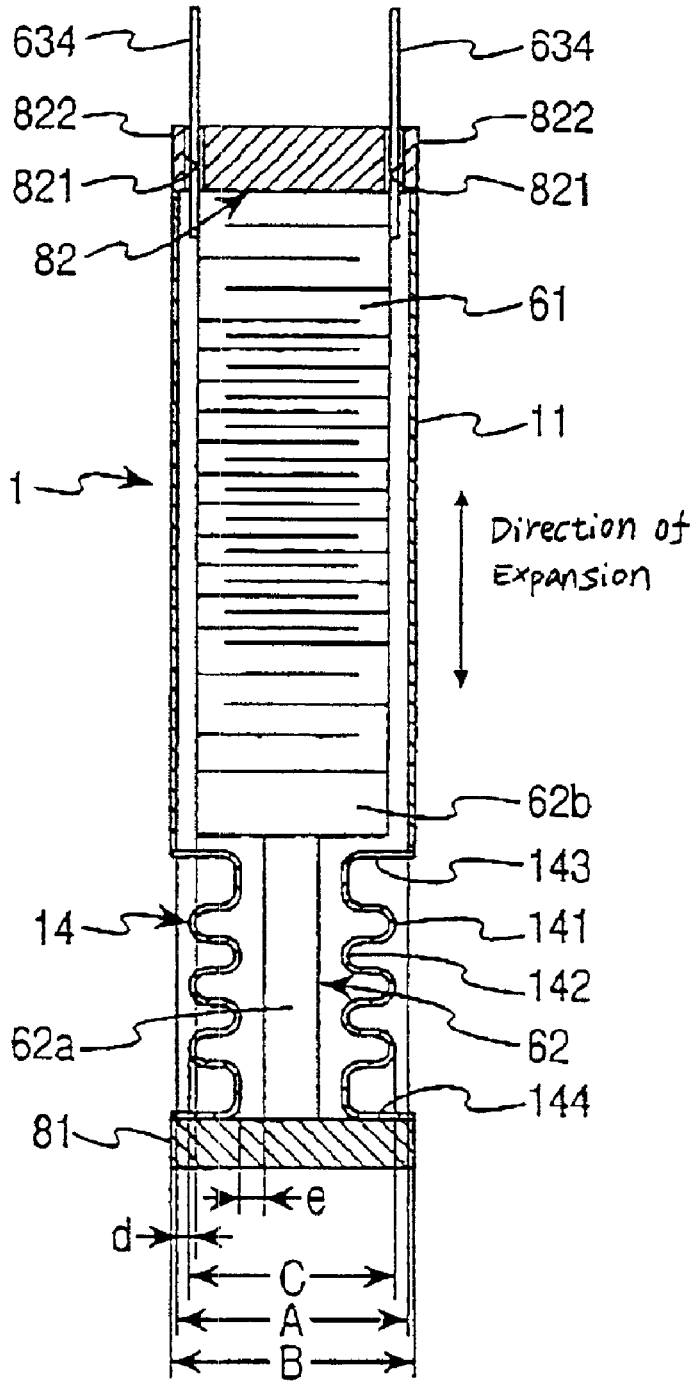
FIG. 10 is a vertical sectional view which shows an actuator installed in the fuel injector of FIG. 9.

The actuator 1, as clearly shown in FIG. 10, includes a piston 62 coupled to the lower end of the piezoelectric device 61, a metallic hollow cylindrical housing 11, and an extensible member 14 coupled to the lower end of the housing 11. The piston 62 is disposed in the extensible member 14 in alignment with the piezoelectric device 61 installed within the housing 11. A head plate 81 is joined to a head 144 of the extensible member 14. A plate 82 is joined to the upper end of the housing 11 to seal it hermetically.

The piezoelectric device 61 may be used in any of the above described first to fifth embodiments. The piezoelectric device 61, as clearly shown in FIGS. 11 to 12(*c*), consists of a stack of piezoelectric layers 61A and positive and negative inner electrodes 621 and 622 which are disposed alternately between the piezoelectric layers 61A, respectively. Each of the positive inner electrodes 621 extends at one side thereof to a side: surface 601 of one of the piezoelectric layers 61A, while each of the negative inner electrodes 622 extends at one side thereof to a side surface 602 opposite to the side surface 601. Specifically, the positive and negative electrodes 621 and 622 are exposed to opposite side walls of the piezoelectric device 61, respectively. The positive and negative electrodes 621 and 622 are coupled at the exposed sides thereof to each other through vertically extending side electrodes 631 and 632. The side electrodes 631 and 632 are each made by baking a silver paste containing 97% of Ag and 3% of glass frit.

Outer electrodes 634 are, as shown in FIG. 10, coupled to the side electrodes 631 and 632 using a conductive adhesive. The outer electrodes 634 are each made of a 18-8 stainless steel. The conductive adhesive is made from a resinous silver containing 80% of Ag and 20% of epoxide.

Figure 11:
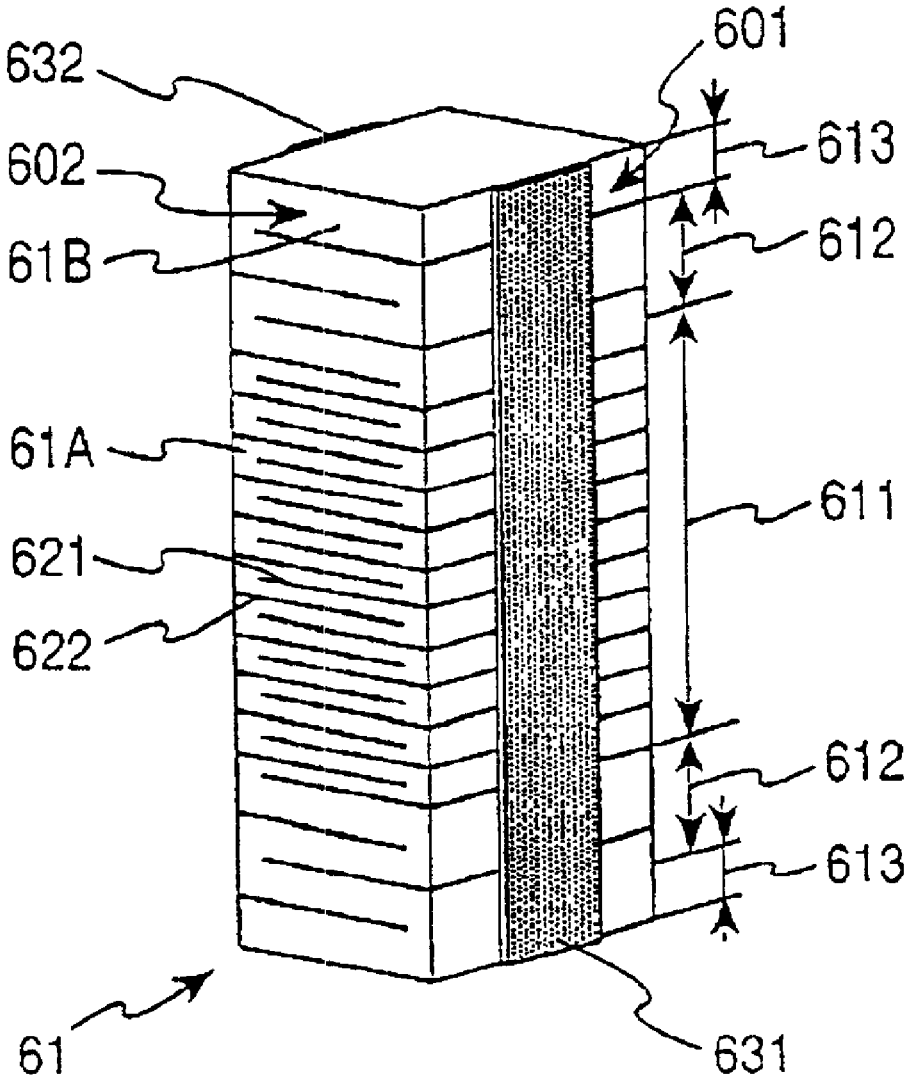
FIG. 11 is a perspective view which shows a piezoelectric device built in the actuator of FIG. 10.

The piezoelectric device 61, as clearly shown in FIG. 11, consists essentially of three parts: a drive portion 611 ranging over a central portion of the piezoelectric device 61 in a lengthwise direction thereof, buffer portions 612 located on both sides of the drive portion 611, and dummy portions 613 located at the ends of the piezoelectric device 61.

The piezoelectric device 61 is produced using known green sheets. The green sheet is made in the following manner. First, powders of lead oxide, zirconium oxide, titanium oxide, niobium oxide, and strontium carbonate that are main components of a piezoelectric material are prepared at a given rate. For compensating for a loss of the lead caused by evaporation in a subsequent process, it is preferably enriched by about 1 to 2% in a stoichometric ratio. Next, the powders are mixed and dried in a mixing chamber and then baked temporarily at 800 to 950° C. To this mixture, demineralized water and dispersant is added to produce slurry. The slurry is subjected to the wet grinding using a mill, dried, and then decreased to remove binder, after which it is mixed with solvent, binder, plasticizer, and dispersant in a ball mill. This is then agitated using an agitator within a vacuum device to be degassed and adjusted in viscosity.

Next, the slurry is, shaped using a doctor blade device into a layer of a constant thickness to produce a green sheet. The green sheet withdraws from the doctor blade device is cut in a cutting machine or a press machine to a rectangular shape. Note that the drive portion 611, the buffer portions 612, and the dummy portions 613 are made of the same green sheets.

Figure 12A:
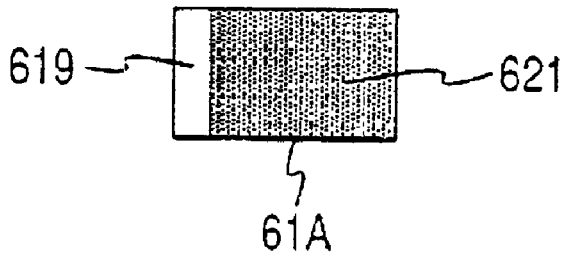
FIGS. 12(*a*) and 12(*b*) are views which show adjacent piezoelectric layers raking up the piezoelectric device of FIG. 11.
Figure 12B:
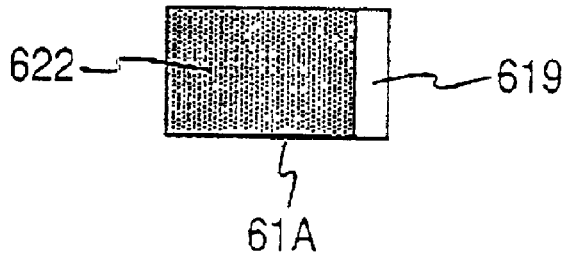
Figure 12C:
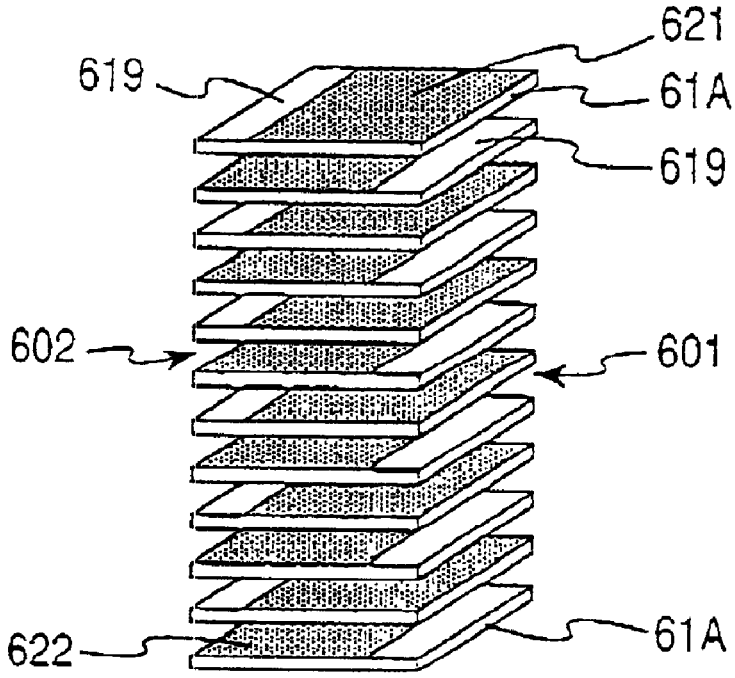

An Ag/Pd paste containing of silver and palladium of 7:3 ratio is applied to one surface of the rectangular green sheet to print an electrode pattern (i.e., the inner electrode 621 or 622 in FIG. 12(*a*) or 12(*b*)), using screen printing techniques to form each of the piezoelectric layers 61A.

Each of the inner electrodes 621 and 622, as can be seen from FIGS. 12(*a*) and 12(*b*), occupies one surface of the piezoelectric layer 61A other than a side portion 619. Specifically, each of the inner electrodes 621 and 622 of a stack of the piezoelectric layers 61A reaches either of the side surfaces 601 and 602. The inner electrodes 612 and 622 may alternatively be made of copper, nickel, platinum, or silver or a mixture thereof.

The piezoelectric layers 61A of a number required to provide a desired amount of expansion of the whole of the drive portions 611 and the buffer portions 612 are prepared in the above manner. Additionally, the rectangular green sheets on which no electrodes are formed are also prepared which are employed as piezoelectric layers 61B, as will be described below in detail, in forming the buffer portions 612 and the dummy portions 613.

The piezoelectric layers 61A and 61B are stacked up in the following manner to produce the piezoelectric device 61. FIG. 12(*c*) illustrates only the drive portion 611 for convenience. The drive portion 611 is made by stacking the piezoelectric layers 61A so that the electrode-nonformed side portions 619 are alternately oriented in opposite directions. Half of the inner electrodes 621 of the piezoelectric layers 61A exposed to the side surface 601, as shown in FIG. 11, are used as positive electrodes, while the remainders exposed to the side surface 602 are used as negative electrodes.

The buffer portions 612 are each made by stacking the piezoelectric layers 61A and the electrode-nonformed piezoelectric layers 61B alternately. The dummy portions 613 are each made by stacking only the piezoelectric layers 61B. In this manner, a stack of the piezoelectric layers, 61A and 61B, as shown in FIG. 11, is produced.

The thus produced piezoelectric stack is thermo-compressed using, for example, a hot-water rubber press, after which it is degreased at 400 to 700° C. in an electric furnace and baked at 900 to 1200° C.

An Ag paste is applied to the side surfaces 601 and 602 of the piezoelectric stack and baked to form the side electrodes 631 and 632 which lead electrically to the inner electrodes 621 and 622, respectively. The side electrodes 631 and 632 may alternatively be made of an Ag/Pd paste or using copper, nickel, platinum, or silver/palladium.

External electrodes 634 are, as shown in FIG. 10, joined to the side electrodes 631 and 632 using a conductive adhesive. Next, a dc voltage is applied to the inner electrodes 621 and 622 through the external electrodes 634 to polarize a stack of the piezoelectric layers 61A to produce the piezoelectric device 61. The external electrodes 634 may alternatively be soldered or brazed to the side electrodes 631 and 632 or bonded directly to the inner electrodes 621 and 622, respectively, without using the side electrodes 631 and 632. The external electrodes 634 are preferably formed by a waved strip made of a metallic foil or a waved metallic wire which may be sheathed.

The dummy portions 613 are, as described above, made up of the piezoelectric layers 61B which are identical in material with the piezoelectric layers 61A, thus resulting in a decrease in manufacturing cost of the piezoelectric device 61.

Finally, the thus produced piezoelectric device 61 is disposed in the housing 11 and compressed through the piston 62 and the head plate 81 by the reactive force from the extensible member 14.

The piston 62, as shown in FIG. 10, consists of a base 62*b* substantially identical in sectional area with the piezoelectric device 61 and a rod 62*a*. The rod 62 has an outer diameter of 6 mm. The piston 62 is made of a quenched stainless steel. To the end of the rod 62, the head plate 81 is joined which is made of a disc member having an outer diameter B of 10.2 mm.

The housing 11 made of a stainless steel pipe which is 0.3 mm in thickness and 10.2 mm in outer diameter A. The extensible member 14 is implemented by a bellows which is made of a stainless steel having a thickness of 0.17 mm and consists of large-diameter portions 141 and small-diameter portions 142 arrayed alternately. The large-diameter portions 141 have a diameter C of 9.5 mm. The small-diameter portions 142 have a diameter of 6.5 mm. The bellows also includes the rear end 143 joined to the end of the housing 11 and the head 144 joined to the head plate 81 The rear end 143 has substantially the same diameter as the diameter A of the housing 11. The head 144 has substantially the same diameter as the diameter B of the head plate 81.

The extensible member 14 is joined at the rear end 143 thereof to the housing 11 and at the head 144 to the head plate 81 hermetically. The upper plate 82 is installed on the upper end of the piezoelectric device 61 to seal the upper opening of the housing 11 hermetically. The upper plate 82 has formed therein holes 821 through which the external electrodes 634 extend outside the housing 11. The upper plate 82 has an outer diameter equal to the outer diameter A of the housing 11. Sealing members 822 are fitted in the through holes 821 to seal gaps between the external electrodes 634 and inner walls of the holes 821, respectively.

The minimum outer diameter A of the housing 11, the maximum outer diameter B of the head plate 81 joined to the rod 62*a* of the piston 62, and the maximum outer diameter C of the extensible member 14 meet the relations of A>C and B>C. Specifically, the extensible member 14 is smaller in diameter than the housing 11 and the head plate 81 installed on both sides of the extensible member 14, thereby avoiding physical contact with the inner wall of the vertical chamber 21 of the fuel injector 100 during operation of the actuator 1, thus resulting in an increase in lifespan of the extensible member 14. Note that at least one of the relations of A>C and B>C may be satisfied.

If a maximum clearance between an inner wall of the housing 11 and the base 62*b* of the piston 62 and a minimum clearance between an inner wall of the extensible member 42 and the rod 62*a* of the piston 62 are defined as d and e, then d<e. This causes the piezoelectric device 61 and the base 62*b* of the piston 62 to hit on the inner wall of the housing 11 when the piston 62 deflects horizontally during the operation of the piezoelectric device 61, thereby avoiding physical contact of the piston rod 62*a* with the extensible member 14 thus resulting in an increase in lifespan of the extensible member 14.

Figure 9:
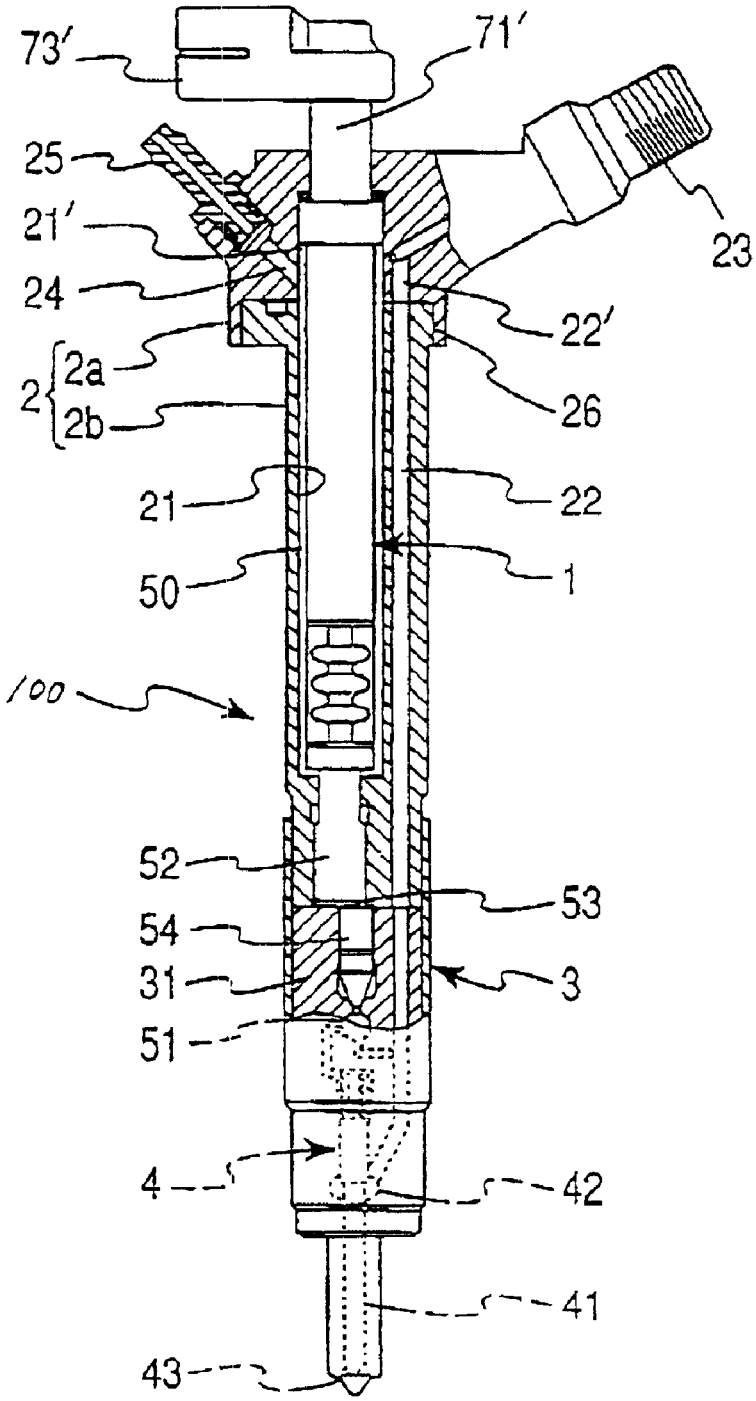
FIG. 9 is a vertical sectional view which shows a fuel injector according to the sixth embodiment of the invention.

The installation of the actuator 1 assembled in the above manner in the fuel injector 100 of FIG. 9 is accomplished by inserting the actuator 1 into the vertical chamber 21 while keeping the gap 50 through which the fuel flows and securing the housing 11 in the same manner as that in the fifth embodiment of FIG. 8 so that the head plate 81 may move in a lengthwise direction of the actuator 1.

As apparent from the above discussion, the actuator 1 of this embodiment has the extensible member 14 joined to the end of the housing 11 in alignment therewith so as to absorb a lengthwise movement of the piezoelectric device 61 and the piston 62, thus eliminating the need for the housing 11 to have an extensible portion in itself. This allows the housing 11 to be minimized in thickness, so that the outer diameter of the housing 11 can be decreased, thereby allowing the size of the actuator 1 to be reduced without sacrificing the performance of the piezoelectric device 61.

Figure 13A:
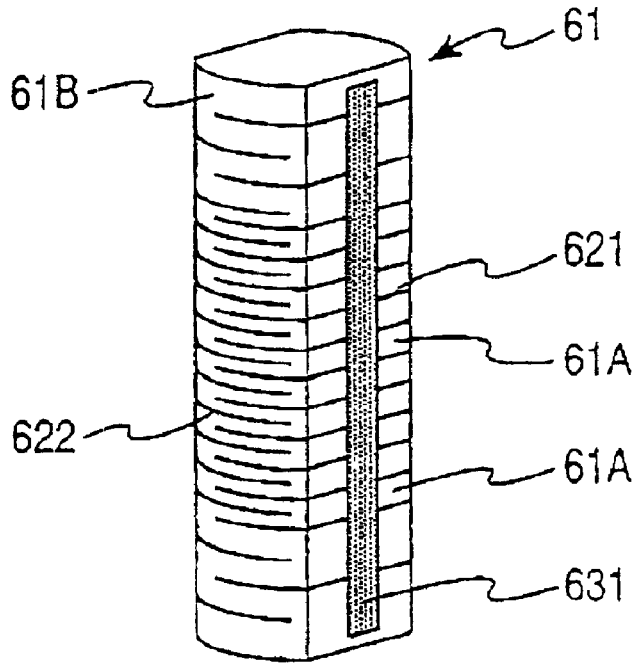
FIGS. 13(*a*) and 13(*b*) are perspective views which show modifications of the piezoelectric device of FIG. 11.
Figure 13B:
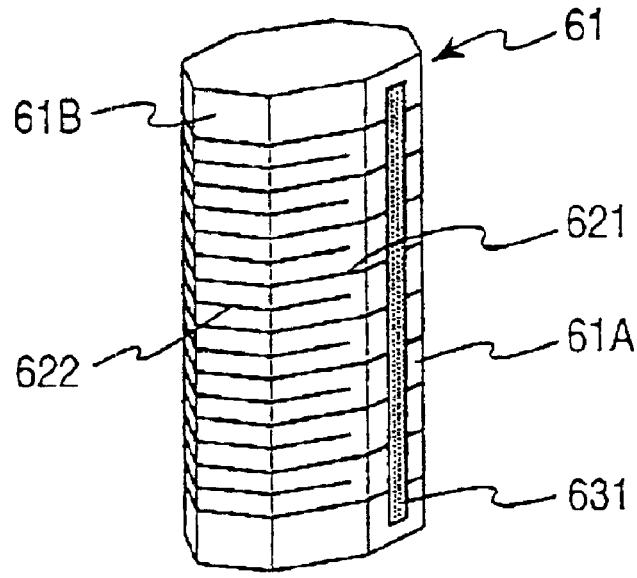

The piezoelectric Crevice 61 is not limited in cross section to a square shape and may alternatively be made up of barrel-shaped piezoelectric layers 61A and 61B, as shown in FIG. 13(*a*) or octagonal piezoelectric layers 61A and 61B, as shown in FIG. 13(*b*).

Figure 14:
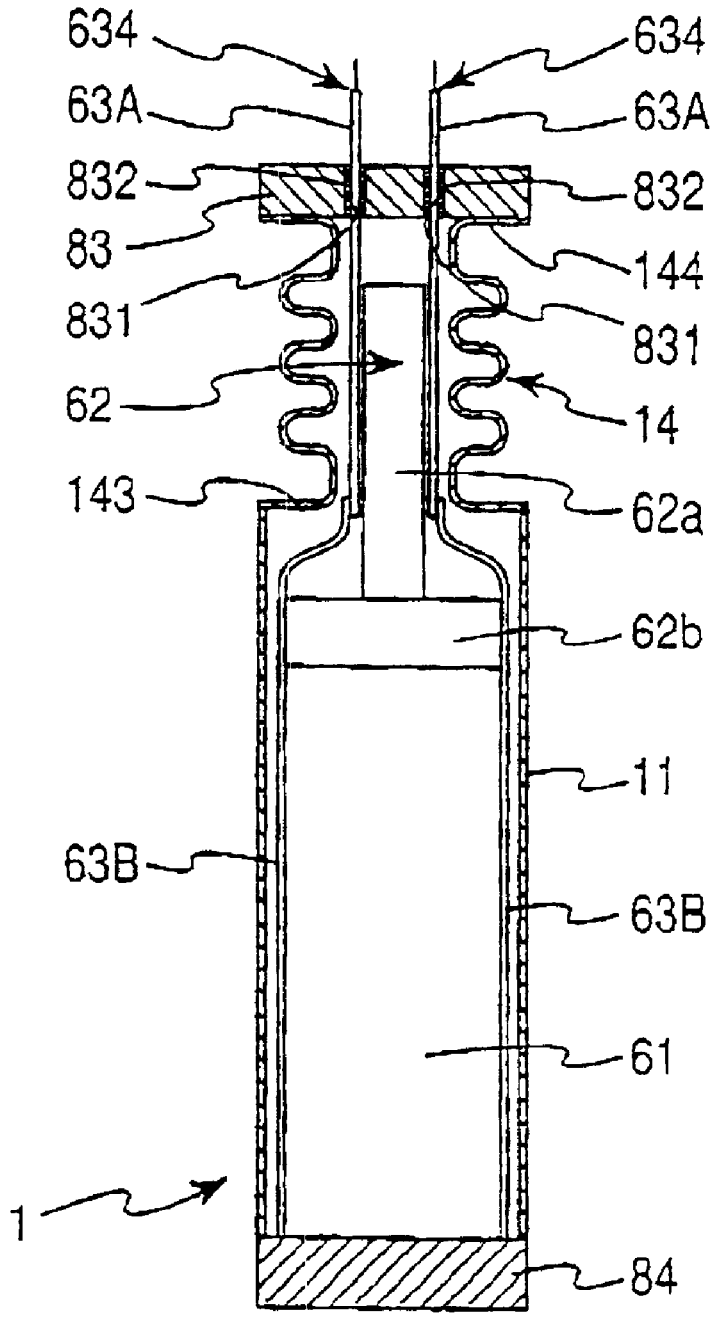
FIG. 14 is a vertical sectional view which shows an actuator according to the seventh embodiment of the invention.

FIG. 14 shows the actuator 1 according to the seventh embodiment of the invention which is a modification of the sixth embodiment. Specifically, the piston 62 is reverse in location on the piezoelectric device 61 to that in the sixth embodiment.

The piston 62 is installed on the upper end of the piezoelectric device 61. The extensible member 14 is joined at the rear end 143 to the upper end of the housing 11 and at the head 144 to the plate 83. The plate 83 has formed therein holes 831 through which the external electrodes 634 extend. Sealing members 832 are fitted in the holes 831 to seal gaps between inner wall of the holes 831 and the external electrodes 634 hermetically. The external electrodes 634 are welded to wires 63A which extend outside the plate 83 and to conductive members 63B which extend downward, as viewed in the drawing, and connect with the side electrodes of the piezoelectric device 61. The external electrodes 634 may alternatively be soldered or brazed to the wires 63A and the conductive members 63B or staked to establish electric communications therewith. Each of the conductive members 631 is joined to an overall length of one of the side electrodes of the piezoelectric device 61.

The housing 11 is made of a stainless steel and stores therein the piezoelectric device 61. The housing 11 is identical in diameter with the one in the first embodiment. The extensible member 14 is made of a stainless steel and identical in structure with the one in the sixth embodiment.

A lower plate 84 having the same diameter as that of the housing 11 is joined to a lower end of the housing 11.

The actuator 1 of this embodiment is installed in the fuel injector 100 identical in structure with the one in the sixth embodiment. Specifically, the piezoelectric device 61 is so secured in the upper housing 2 that the housing 11 can be moved vertically by the activation of the piezoelectric device 61. Other arrangements are identical with those in the sixth embodiment, and explanation thereof in detail will be omitted here.

Figure 15:
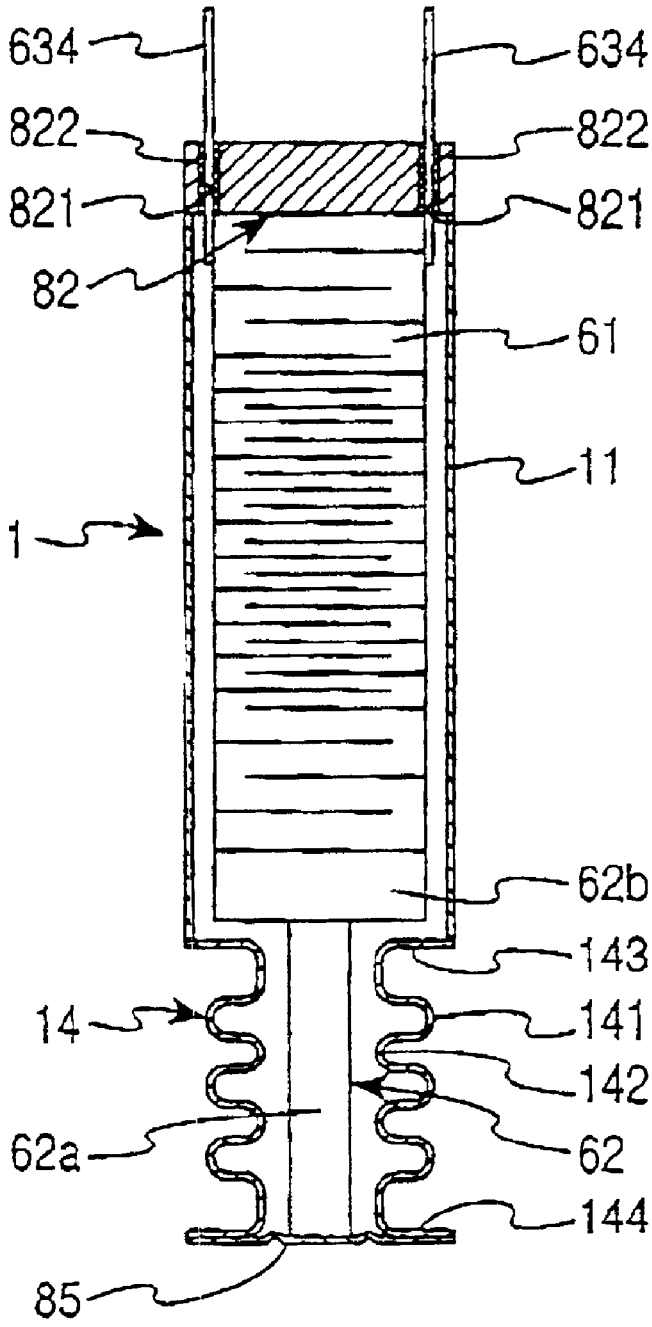
FIG. 15 is a vertical sectional view which shows an actuator according to the eighth embodiment of the invention.

FIG. 15 shows the actuator 1 according to the eighth embodiment of the invention which is different from the sixth embodiment only in that a diaphragm 85 is used. Other arrangements are identical, and explanation thereof in detail will be omitted here.

The diaphragm 85 is joined to the head 144 of the extensible member 14 in physical contact with the end of the rod 62*a* of the piston 62 so that a central portion of the diaphragm 85 may be deformed vertically by a vertical movement of the piston 62. The diaphragm 85 has the sane diameter as that of the head 144 and is made of a metallic disc spring.

Figure 16:
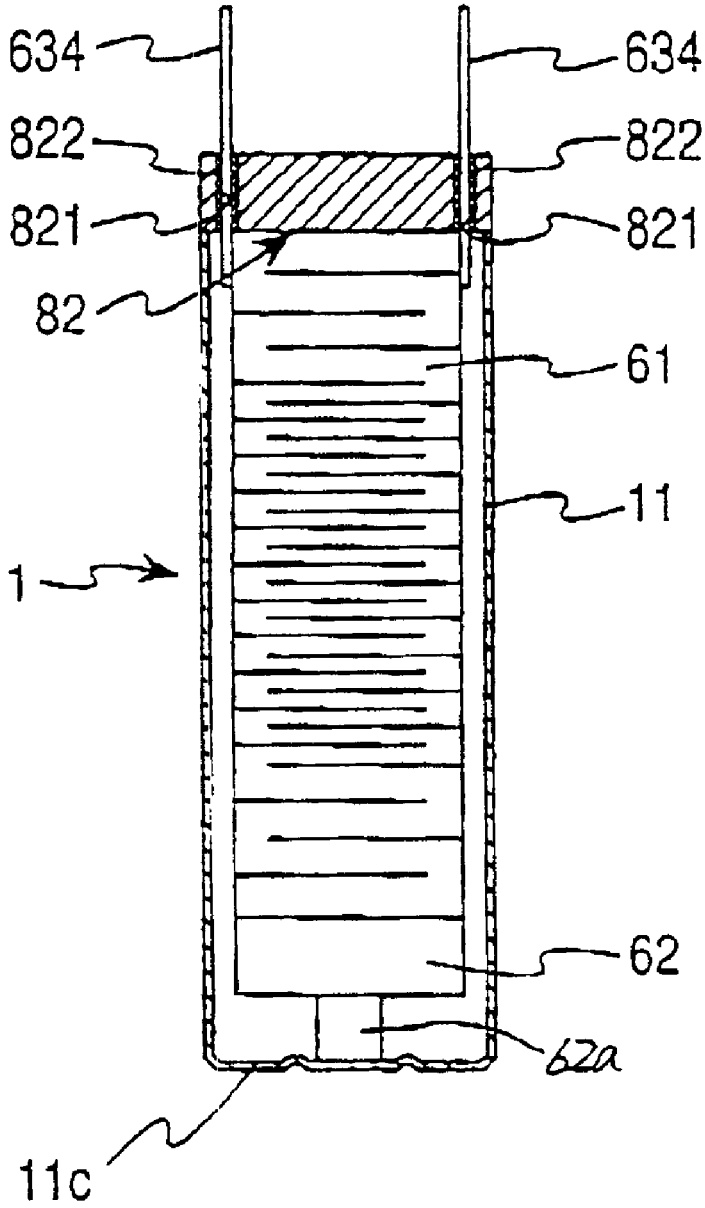
FIG. 16 is a vertical sectional view which shows an actuator according to the ninth embodiment of the invention.

FIG. 16 shows the actuator 1 according to the ninth embodiment of the invention.

The piston 62 has the rod 62*a* which is shorter than that in the eighth embodiment of FIG. 15 and connects at an end thereof to a central portion of the diaphragm 11*c*. The diaphragm 11*c* is formed integrally with a lower end of the housing 11. Other arrangements are identical with those in the eighth embodiment, and explanation thereof in detail will be emitted here.

Figure 17:
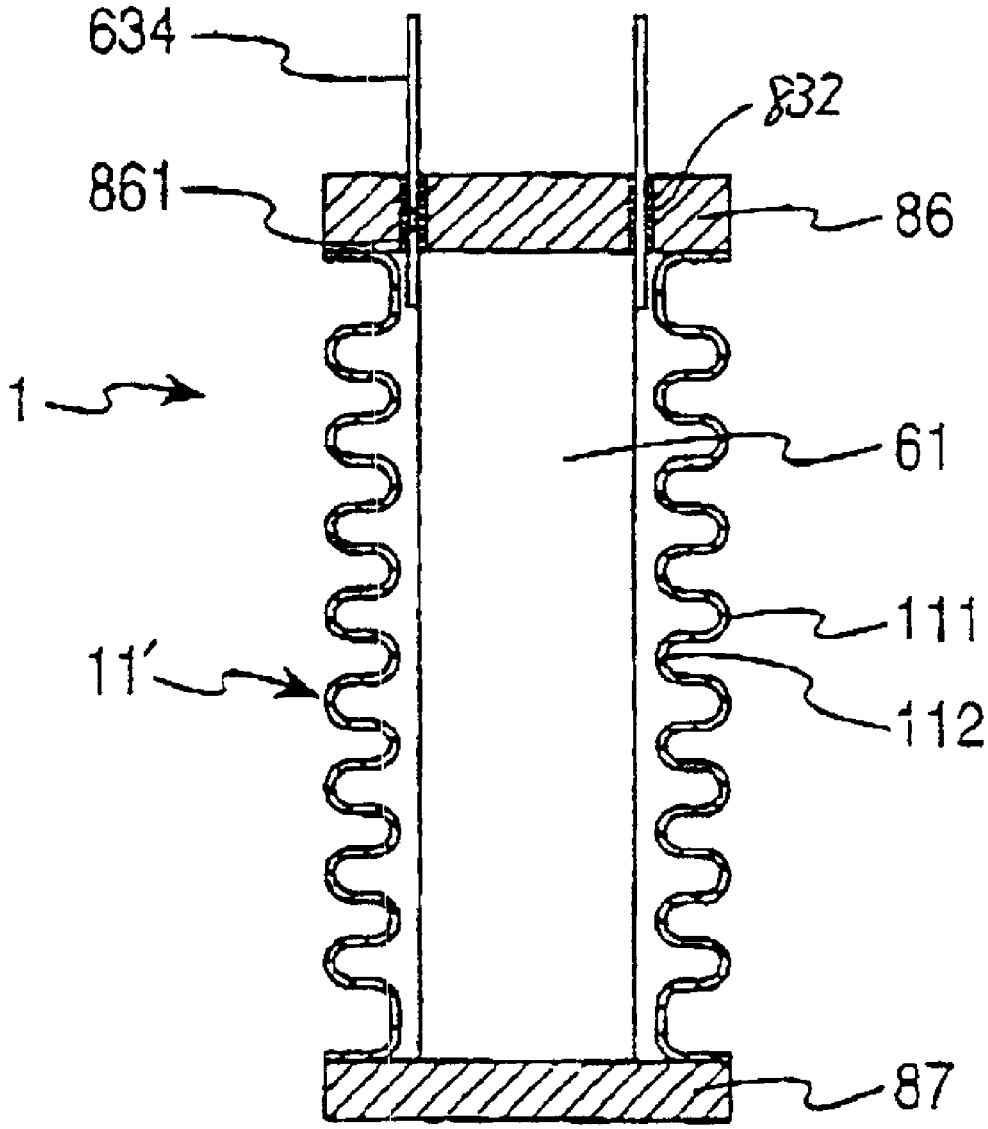
FIG. 17 is a vertical sectional view which shows an actuator according to the tenth embodiment of the invention, FIGS. 18(*a*), 18(*b*), 18(*c*), and 18(*d*) are sectional views which show modifications of the actuator of FIG. 17.
Figure 18A:
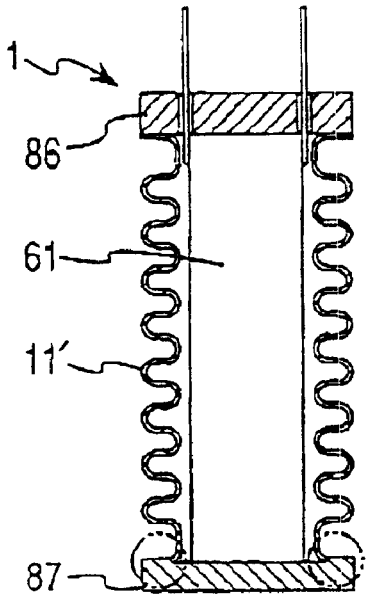
Figure 18B:
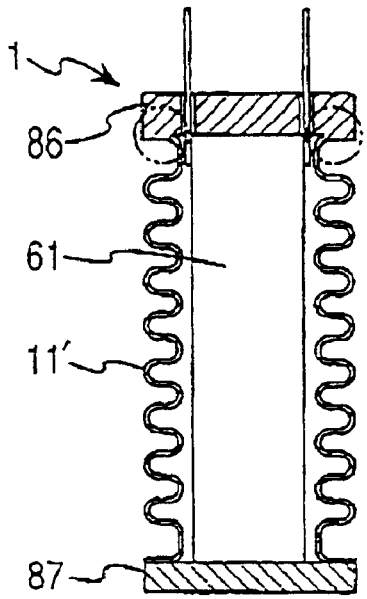
Figure 18C:
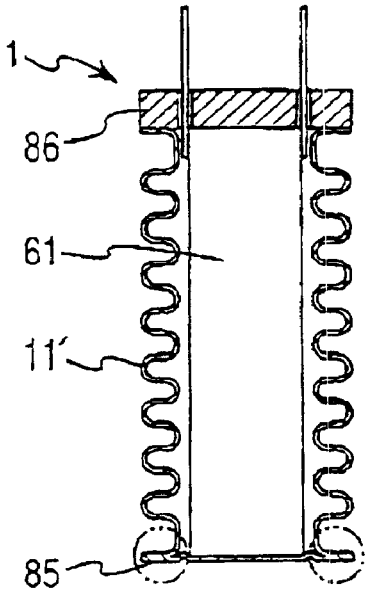
Figure 18D:
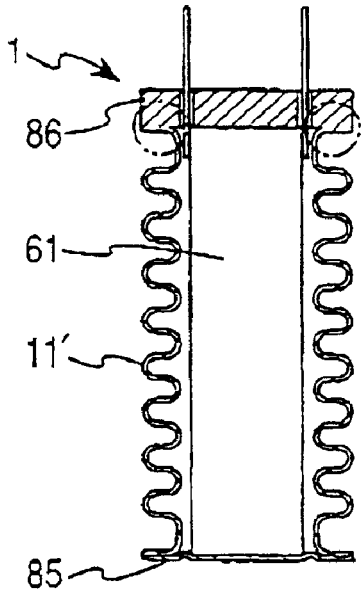
Figure 19A:
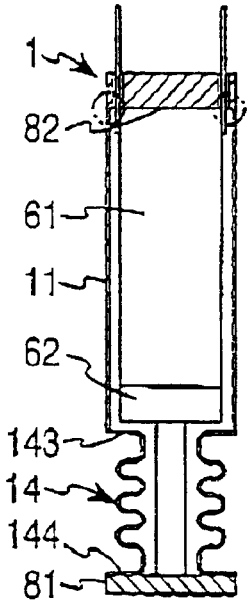
FIGS. 19(*a*), 19(*b*), 19(*c*), 19(*d*), 19(*e*), and 19(*f*) are sectional views which show modifications of the actuator of FIG. 10.
Figure 19B:
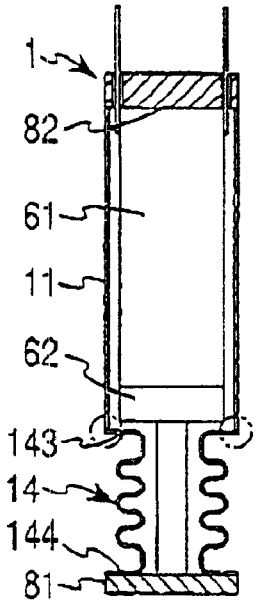
Figure 19C:
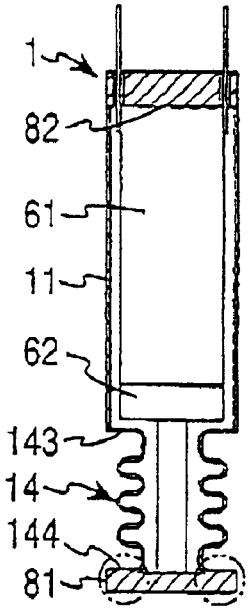
Figure 19D:
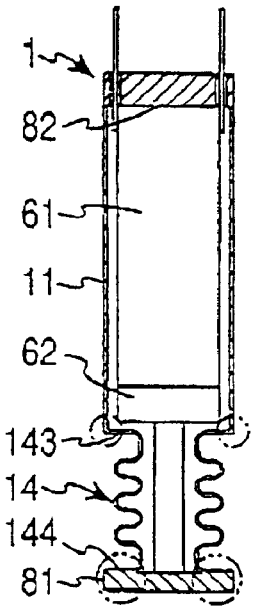
Figure 19E:
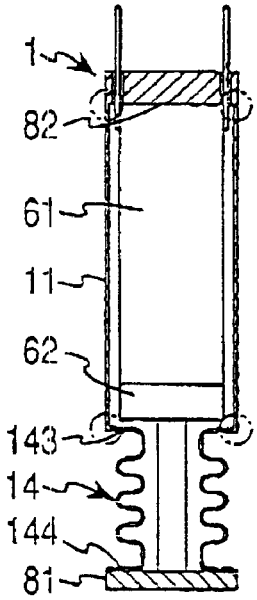
Figure 19F:
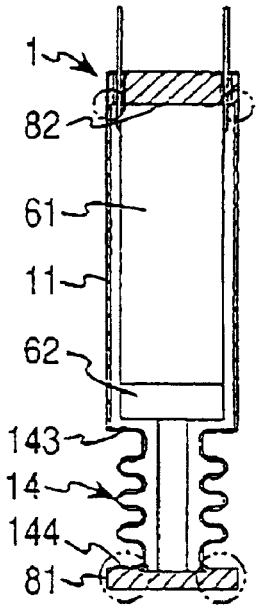
Figure 20A:
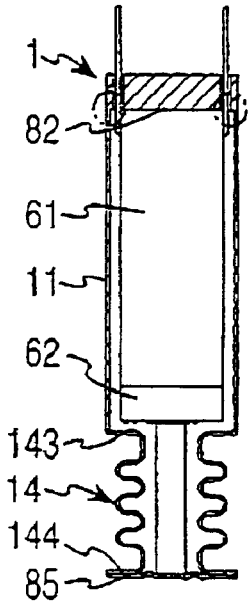
FIGS. 20(*a*), 20(*b*), 20(*c*), 20(*d*), 20(*e*), and 20(*f*) are sectional views which show modifications of the actuator of FIG. 15.
Figure 20B:
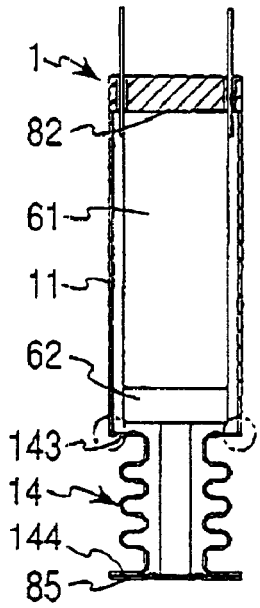
Figure 20C:
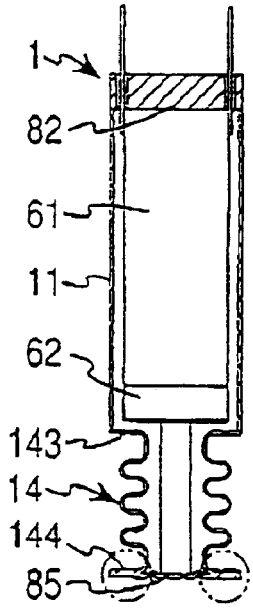
Figure 20D:
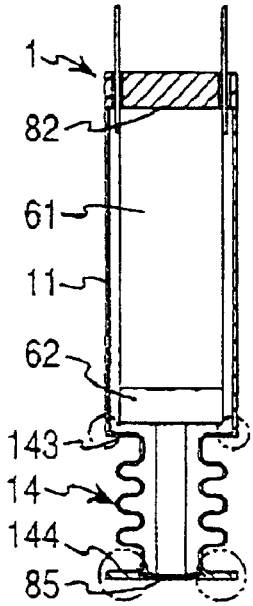
Figure 20E:
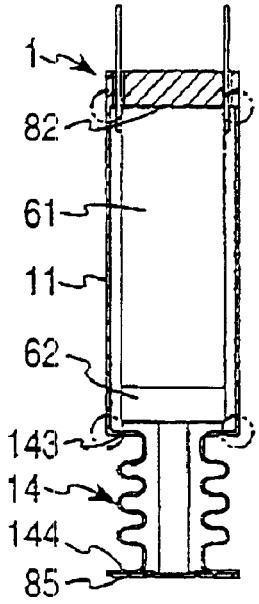
Figure 20F:
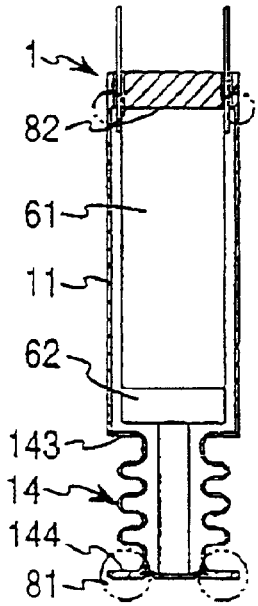

FIG. 17 shows the actuator 1 according to the tenth embodiment of the invention which is different from the above embodiments in that the movement of the piezoelectric device 61 is transmitted directly to the large-diameter piston 52 without use of a piston.

The housing 11' is made of a metallic cylindrical bellows consisting of large-diameter portions 111 and small-diameter portions 112 arrayed alternately. The housing 11' is closed by an upper plate 86 and a lower plate 87 hermetically. The upper plate 86 has formed therein holes 861 through which the external electrodes 634 extend outside the housing 11'. The sealing members 832 are fitted ill the holes 861 to seal gaps between inner wall of the holes 861 and the external electrodes 634 hermetically.

The piezoelectric device 61 is disposed within the housing 11' and compressed elastically by the upper and lower plates 86 and 87 through the housing 11'. When energized, the piezoelectric device 61 expands vertically along with expansion of the housing 11' to push the lower plate 87 downward, as viewed in the drawing. The structure of this embodiment results in decreases in parts to be assembled and parts-joining process, thereby simplifying the parts management and production processes.

The housing 11' may alternatively be formed integrally, as shown by circles in FIGS. 18(*a*) and 18(*b*), at a lower end or an upper end thereof with the lower plate 87 or the upper plate 86. Additionally, the lower plate 87 may be replaced, as shown in FIG. 18(*c*) or 18(*d*), with a diaphragm 85. In FIG. 18(*c*), the housing 11' is formed integrally at the lower end thereof with the diaphragm 85. In FIG. 18(*d*), the housing 11' is formed integrally at the upper end thereof with the upper plate 86. The diaphragm 85 is joined to the lower end of the housing 11'.

It is important for the structure in which the piezoelectric device 61 is disposed in the housing 11 to ensure the airtightness. However, as the number of parts making up the actuator 1 increases, the possibility that failures in joining the parts increase, resulting in leakage of air will increases, and the manufacturing costs will also increase. In order to avoid these problems, it is advisable that at least two of the housing 11', the upper plate 86, and the lower plate 87 be formed integrally with each other. This results in a decrease in joint of the actuator 1 thereby assuring the actuator remains highly airtight and also decreasing the manufacturing costs.

Similarly, the actuator 1 of the sixth embodiment in FIG. 10 may also have parts formed integrally with each other, as shown in FIGS. 19(*a*) to 19(*f*). In FIG. 19(*a*), the upper plate 82 is formed integrally with the housing 11. In FIG. 19(*b*), the rear end 143 of the extensible member 14 is formed integrally with the lower end of the housing 11. In FIG. 19(*c*), the head plate 81 is formed integrally with the extensible member 14. At least two of these parts, as clearly shown by circles in FIGS. 19(*d*) to 19(*f*), may also be formed integrally with each other.

Additionally, the actuator 1 of the eighth embodiment in FIG. 15 may also have parts formed integrally with each other, as shown in FIGS. 20(*a*) to 20(*f*). In FIG. 20(*a*), the upper plate 82 is formed integrally with the housing 11. In FIG. 20(*b*), the rear end 143 of the extensible member 14 is formed integrally with the lower end of the housing 11. In FIG. 20(*c*), the diaphragm 85 is formed integrally with the extensible member 14. At least two of these parts, as clearly shown by circles in FIGS. 20(*d*) to 20(*f*), may also be formed integrally with each other.

Figure 21:
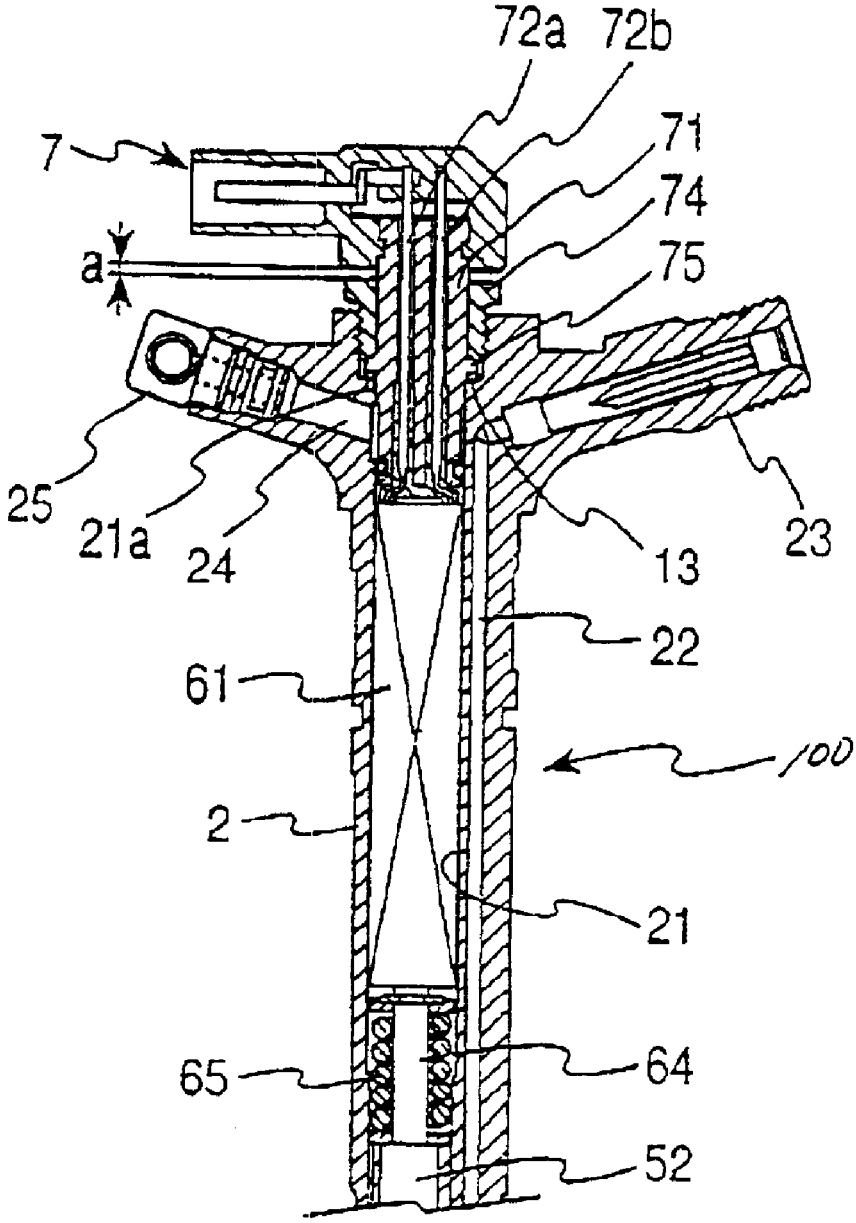
FIG. 21 is a partially sectional view which shows a fuel injector according to the eleventh embodiment of the invention.

FIG. 21 shows the fuel injector 100 according to the eleventh embodiment of the invention.

The piezoelectric crevice 61 is disposed directly within the vertical chamber 21 of the upper housing 2 without use of the housing 11. The connector body 71 is secured on the upper end of the piezoelectric device 61. The installation of the piezoelectric device 61 in the vertical chamber 21 of the upper housing 2 is accomplished, similar to the first embodiment, by inserting the piezoelectric device 61 to which the connector 7 is joined into the vertical chamber 21 from the upper opening of the upper housing 2, holding an upper end portion of the connector body 71, as indicated by a, using a given tool, and fastening the retaining nut 74 to nip the flange 75 of the connector body 71 between the retaining nut 74 and the shoulder 21*a* of the upper housing 2 through the shim 13. The shim 13 serves as a spacer for adjusting a vertical location of the piezoelectric device 61 within the upper housing 2. This avoids application of undesirable torque or unbalanced load to the actuator 1 during installation in the upper housing 2.

It is impossible for this structure to define a drain passage between the outer wall of the piezoelectric device 61 and the inner wall of the vertical chamber 21. A fuel passage (not shown) is, therefore, formed directly in the upper housing 2 which leads to the three-way valve 51. The vertical displacement of the piezoelectric device 61 is transmitted to the large-diameter piston 52 through the rod 64. Other arrangements are identical with those in the first embodiment, and explanation thereof in detail will be omitted here.

Figure 22:
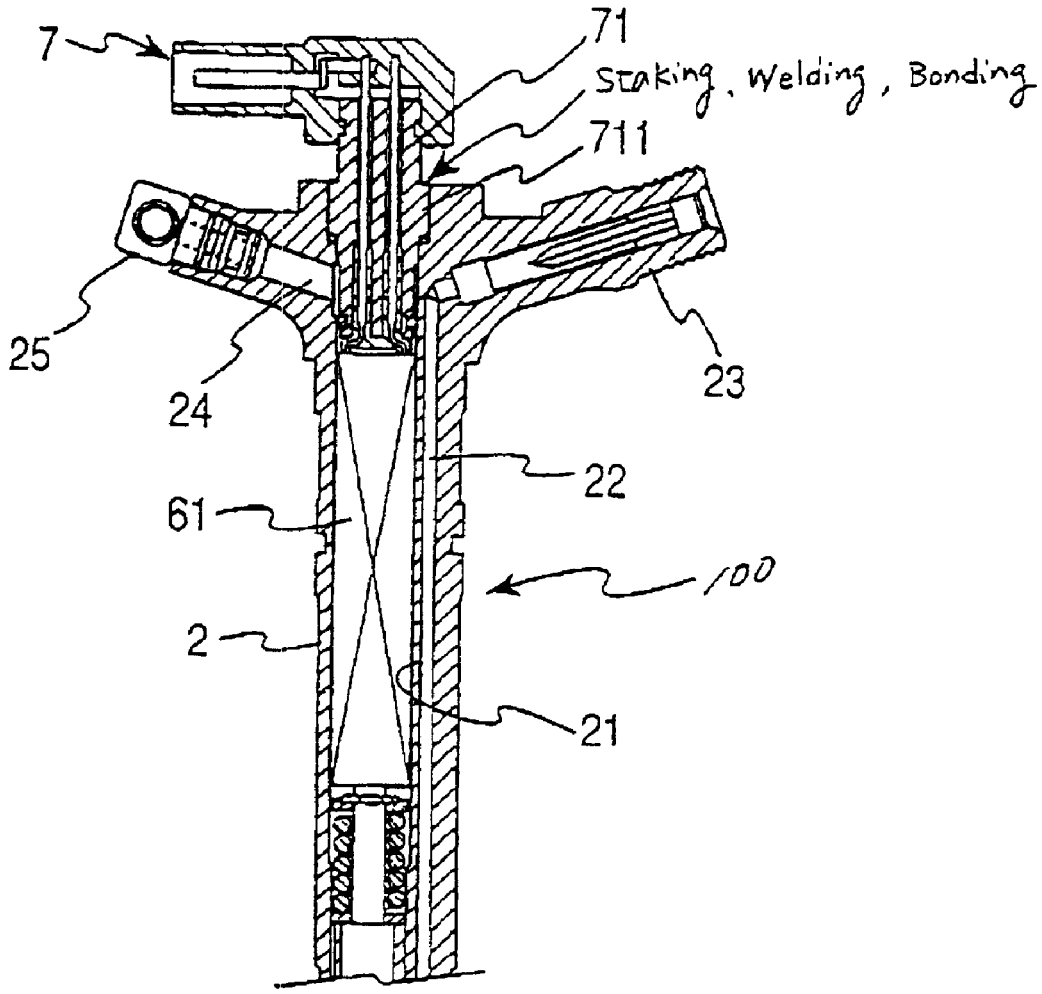
FIG. 22 is a partially sectional view which shows a fuel injector according to the twelfth embodiment of the invention.

In a case where there is no need for replacing or adjusting the piezoelectric device 61, and it is required only to withdraw the piezoelectric device 61 from the fuel injector 100 for discarding it, the connector body 71, as shown in FIG. 22 as the twelfth embodiment, may be secured in the upper housing 2 by staking, welding, or bonding a flange 711 formed on a middle portion of the connector body 71 in the upper end of the upper housing 2. It is advisable that the strength of a joint of the connector body 71 and the upper housing 2 be lower than that of another portion for facilitating ease of removal of the piezoelectric device 61.

Figure 23:
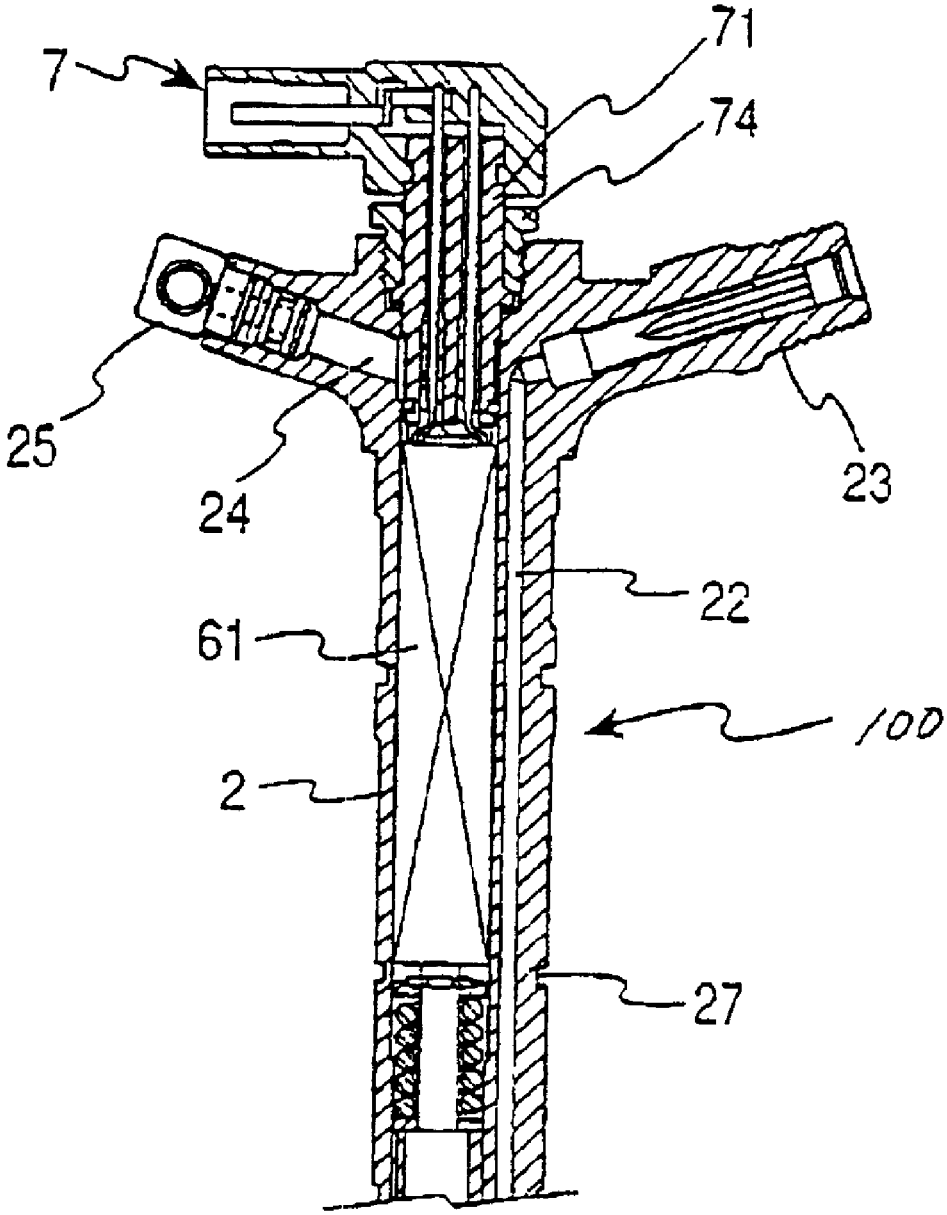
FIG. 23 is a partially sectional view which shows a fuel injector according to the thirteenth embodiment of the invention.

FIG. 23 shows the fuel injector 100 according to the thirteenth embodiment of the invention.

The upper housing 2 has at least one fragile portion 27 formed near the lower end of the piezoelectric device 61 for facilitating ease of cutting or breaking up the upper housing 2 in order to withdraw the piezoelectric device 61. The fragile portion 27 is defined by an annular groove formed in a peripheral outer wall of the upper housing 2.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims. For example, the three-way valve 51 is used to open and close the injection nozzle 4, however, the invention is not limited to the same. Another known mechanism may be used to open and close the injection nozzle 4. Further, the actuator 1 is implemented by a piezoelectric device, however, another element may be used as long as it is so constructed as to be expand and contract in response to input of an electric signal.

What is claimed is:

1. A fuel injector for an internal combustion engine comprising:

a housing to be installed in the engine with a portion of the housing exposed outside the engine, an actuator including an electrically deformable element which works to be deformed in response to input of an electric signal for opening and closing a spray hole selectively, a structural element installing said actuator in said housing detachably, wherein said housing has formed therein a vertical chamber which has an opening oriented to a first end of said housing exposed outside the engine, said structural element includes a fastening member which retains said actuator detachably within the vertical chamber, and a nozzle needle disposed in alignment with said actuator within a chamber formed in said housing opposite the first end across the vertical chamber so as to be moved in a lengthwise direction of said housing by the deformation of said actuator to open and close the spray hole selectively, wherein said actuator has a length with a first end oriented toward the first end of said housing, and further comprising a spacer disposed between a flange coupled with the first end of said actuator and a shoulder formed in said housing for adjusting a lengthwise location of said actuator within said vertical chamber.

2. A fuel injector for an internal combustion engine comprising:

a housing to be installed in the engine with a portion of the housing exposed outside the engine, an actuator including an electrically deformable element which works to be deformed in response to input of an electric signal for opening and closing a spray hole selectively, a structural element installing said actuator in said housing detachably, wherein said housing has formed therein a vertical chamber which has an opening oriented to a first end of said housing exposed outside the engine, said structural element includes a fastening member which retains said actuator detachably within the vertical chamber, and a nozzle needle disposed in alignment with said actuator within a chamber formed in said housing opposite the first end across the vertical chamber so as to be moved in a lengthwise direction of said housing by the deformation of said actuator to open and close the spray hole selectively, wherein said fastening member is fastened to the opening of said vertical chamber in said housing to hold said actuator detachably within the vertical chamber, and further comprising a positioning means for positioning said actuator within said vertical chamber without being subjected to torque or unbalanced load arising from fastening of said fastening member, and said actuator has a length with a first end oriented toward the first end of said housing, and a connector coupled with the first end of said actuator for establishing an electric connection between said actuator and a power source, said connector including an electric terminal portion and a connector body extending from a surface of the electric terminal portion, and wherein said fastening member is implemented by a retaining nut through which the connector body extends, said retaining nut being installed in the opening of said vertical chamber with an outer end facing the surface of the electric terminal portion of said connector through a gap of 5 to 10 mm so that a portion of the connector body is exposed outside said retaining nut.

3. A fuel injector as set forth in claim 1, wherein said structural element is implemented by one of a screw and a structural member joined to said housing by one of staking, welding, and bonding.

4. A fuel injector as set forth in claim 3, wherein a joint of the structural member and said housing is more fragile than any other portions.

5. A fuel injector as set forth in claim 3, further comprising at least one fragile portion formed on said housing for facilitating ease of cutting or breaking up said housing for withdrawing said actuator.

6. A fuel injector as set forth in claim 1, wherein said electrically deformable element is implemented by a piezoelectric device designed to expand and contract in response to the input of the electric signal, said piezoelectric device being made up of a stack of piezoelectric layers and electrode layers each interposed between adjacent two of said piezoelectric layers.

7. A fuel injector for an internal combustion engine comprising:

a hollow cylindrical housing having a first and a second opening formed in opposed ends thereof, respectively;

an actuator disposed within said housing, said actuator including an electrically deformable element which works to be deformed in response to input of an electric signal;

a first plate installed on one of the ends of said housing to seal the first opening hermetically; and a second plate installed on the other end of said housing to seal the second opening hermetically, said second plate being so coupled to said housing as to transform the deformation of said electrically deformable element of said actuator into a stroke of a needle for opening and closing a spray hole selectively, wherein said second plate is coupled to said housing so as to be deformed elastically in response to the deformation of said electrically deformable element to produce the stroke of said needle.

8. A fuel injector as set forth in claim 7, wherein said housing includes a bellows which expands and contracts following the deformation of said electrically deformable element.

9. A fuel injector for an internal combustion engine comprising:

a hollow cylindrical housing having a first and a second opening formed in opposed ends thereof, respectively;

an actuator disposed within said housing, said actuator including an electrically deformable element which works to be deformed in response to input of an electric signal;

a first plate installed on one of the ends of said housing to seal the first opening hermetically;

a second plate installed on the other end of said housing to seal the second opening hermetically, said second plate being so coupled to said housing as to transform the deformation of said electrically deformable element of said actuator into a stroke of a needle for opening and closing a spray hole selectively; and a piston coupled at an end thereof to said electrically deformable element so as to move following deformation of said electrically deformable element within said cylindrical housing, and wherein said second plate is a diaphragm coupled to said housing in contact with the other end of said piston.

10. A fuel injector for an internal combustion engine comprising:

a hollow cylindrical housing having a first and a second opening formed in opposed ends thereof, respectively;

an actuator disposed within said housing, said actuator including an electrically deformable element which works to be deformed in response to input of an electric signal;

a first plate installed on one of the ends of said housing to seal the first opening hermetically;

a second plate installed on the other end of said housing to seal the second opening hermetically, said second plate being so coupled to said housing as to transform the deformation of said electrically deformable element of said actuator into a stroke of a needle for opening and closing a spray hole selectively;

a piston coupled at an end thereof to said electrically deformable element so as to move following deformation of said electrically deformable element within said cylindrical housing, said piston having a rod, wherein said second plate is a diaphragm coupled to said housing in contact with an end of the rod of said piston; and an annular seat member installed within the second opening of said cylindrical housing through which the rod of said piston extends and a spring member disposed on said seat member to exert a given pressure on said electrically deformable member in a lengthwise direction thereof.

11. A fuel injector as set forth in claim 7, wherein said cylindrical housing has a bellows formed on the end in which the second opening is defined, and wherein said second plate is a diaphragm coupled to an end of the bellows to close the second opening.

12. A fuel injector as set forth in claim 7, wherein said cylindrical housing is so designed as to extend following the deformation of said electrically deformable element, wherein at least two of said cylindrical housing, said first plate, and said second plate are formed integrally with each other, and wherein said electrically deformable element is isolated from fluid within said fuel injector.

13. A fuel injector as set forth in claim 7, wherein said electrically deformable element is implemented by a piezoelectric device designed to expand and contract in response to the input of the electric signal, said piezoelectric device being made up of a stack of piezoelectric layers and electrode layers each interposed between adjacent two of said piezoelectric layers.

14. A fuel injector for an internal combustion engine comprising:

a hollow cylindrical housing;

an actuator disposed within said housing, said actuator including an electrically deformable element which works to expand and contract selectively in a lengthwise direction thereof in response to input of an electric signal;

a piston coupled at an end thereof to said electrically deformable element in alignment therewith so as to move following the expansion and contraction of said electrically deformable element; and an extensible member in which said piston is disposed, said extensible member extending in a lengthwise direction thereof so as to allow said piston to move to displace a needle for opening and closing a spray hole selectively, said extensible member being coupled to said housing in alignment therewith in a direction of expansion and contraction of said electrically deformable element and said extendible member being disposed adjacent to and in longitudinal alignment with said electrically deformable element.

15. A fuel injector for an internal combustion engine comprising:

a hollow cylindrical housing;

an actuator disposed within said housing, said actuator including an electrically deformable element which works to expand and contract selectively in a lengthwise direction thereof in response to input of an electric signal;

a piston coupled at an end thereof to said electrically deformable element in alignment therewith so as to move following the expansion and contraction of said electrically deformable element; and an extensible member in which said piston is disposed, said extensible member extending in a lengthwise direction thereof so as to allow said piston to move to displace a needle for opening and closing a spray hole selectively, said extensible member being coupled to said housing in alignment therewith in a direction of expansion and contraction of said electrically deformable element, wherein said extensible member is implemented by a bellows.

16. A fuel injector as set forth in claim 15, further comprising a plate joined to the other end of said piston, and wherein if a minimum diameter of said cylindrical housing is defined as A, a minimum diameter of said plate is defined as B, and a maximum diameter of said extensible member is defined as C, at least one of relations of $A>C$ and $B>C$ is satisfied.

17. A fuel injector for an internal combustion engine comprising:

a hollow cylindrical housing;

an actuator disposed within said housing, said actuator including an electrically deformable element which works to expand and contract selectively in a lengthwise direction thereof in response to input of an electric signal;

a piston coupled at an end thereof to said electrically deformable element in alignment therewith so as to move following the expansion and contraction of said electrically deformable element; and an extensible member in which said piston is disposed, said extensible member extending in a lengthwise direction thereof so as to allow said piston to move to displace a needle for opening and closing a spray hole selectively, said extensible member being coupled to said housing in alignment therewith in a direction of expansion and contraction of said electrically deformable element, wherein the end of said piston coupled said electrically deformable element is disposed within said cylindrical housing, and wherein if a maximum clearance between the end of said piston and an inner wall of said cylindrical housing is defined as d, and a minimum clearance between said piston and an inner wall of said extensible member is defined as e, a relation of $d<e$ is satisfied.

18. A fuel injector for an internal combustion engine comprising:

a hollow cylindrical housing;

an actuator disposed within said housing, said actuator including an electrically deformable element which works to expand and contract selectively in a lengthwise direction thereof in response to input of an electric signal;

a piston coupled at an end thereof to said electrically deformable element in alignment therewith so as to move following the expansion and contraction of said electrically deformable element; and an extensible member in which said piston is disposed, said extensible member extending in a lengthwise direction thereof so as to allow said piston to move to displace a needle for opening and closing a spray hole selectively, said extensible member being coupled to said housing in alignment therewith in a direction of expansion and contraction of said electrically deformable element, a first plate joined to a first end of said cylindrical housing and a second plate jointed to a second end of said cylindrical housing opposite the first end, wherein at least two of said cylindrical housing, said extensible member, said first plate, and said second plate are formed integrally with each other, and wherein said electrically deformable element is isolated from fluid within said fuel injector.

19. A fuel injector for an internal combustion engine comprising:

a hollow cylindrical housing;

an actuator disposed within said housing, said actuator including an electrically deformable element which works to expand and contract selectively in a lengthwise direction thereof in response to input of an electric signal;

a piston coupled at an end thereof to said electrically deformable element in alignment therewith so as to move following the expansion and contraction of said electrically deformable element; and an extensible member in which said piston is disposed, said extensible member extending in a lengthwise direction thereof so as to allow said piston to move to displace a needle for opening and closing a spray hole selectively, said extensible member being coupled to said housing in alignment therewith in a direction of expansion and contraction of said electrically deformable element, wherein said electrically deformable element is implemented by a piezoelectric device designed to expand and contract in response to the input of the electric signal, said piezoelectric device being made up of a stack of piezoelectric layers and electrode layers each interposed between adjacent two of said piezoelectric layers.

20. A fuel injector as set forth in claim 2, wherein said structural element is implemented by one of a screw and a structural member joined to said housing by one of staking, welding, and bonding.

21. A fuel injector as set forth in claim 20, wherein a joint of the structural member and said housing is more fragile than any other portions.

22. A fuel injector as set forth in claim 20, further comprising at least one fragile portion formed on said housing for facilitating ease of cutting or breaking up said housing for withdrawing said actuator.

23. A fuel injector as set forth in claim 2, wherein said electrically deformable element is implemented by a piezoelectric device designed to expand and contract in response to the input of the electric signal, said piezoelectric device being made up of a stack of piezoelectric layers and electrode layers each interposed between adjacent two of said piezoelectric layers.

* * * * *